US012498204B1

(12) United States Patent
Frick

(10) Patent No.: US 12,498,204 B1
(45) Date of Patent: Dec. 16, 2025

(54) FIREARM CARTRIDGE WITH ROLL AND TAPERED CRIMPS AND RELATED METHODS FOR ASSEMBLY

(71) Applicant: Philip Frick, Clinton, CT (US)

(72) Inventor: Philip Frick, Clinton, CT (US)

( * ) Notice: Subject to any disclaimer, the term of this patent is extended or adjusted under 35 U.S.C. 154(b) by 0 days.

(21) Appl. No.: 19/069,415

(22) Filed: Mar. 4, 2025

(51) Int. Cl.

| | |
|---|---|
| ***F42B 7/12*** | (2006.01) |
| ***F42B 5/03*** | (2006.01) |
| ***F42B 5/32*** | (2006.01) |
| ***F42B 33/00*** | (2006.01) |

(52) U.S. Cl.
CPC ..... *F42B 5/03* (2013.01); *F42B 5/32* (2013.01); *F42B 33/005* (2013.01)

(58) Field of Classification Search
CPC ..... F42B 33/12; F42B 33/005; F42B 7/12; F42B 5/067
See application file for complete search history.

(56) References Cited

U.S. PATENT DOCUMENTS 120,403 A * 10/1871 Stetson ..... F42B 7/10 102/439
219,491 A * 9/1879 Mason ..... F42B 7/04 102/452
260,326 A * 6/1882 Salisbury ..... F42B 33/12 86/39
299,162 A * 5/1884 Peters ..... F42B 7/12 102/462
301,179 A * 7/1884 Tice ..... F42B 33/12 86/40
380,689 A * 4/1888 Peters ..... F42B 7/12 102/462
404,811 A * 6/1889 Wichelhaus ..... F42B 33/12 81/426

(Continued)

FOREIGN PATENT DOCUMENTS

| | | |
|---|---|---|
| CA | 2901657 A1 | 2/2017 |
| KR | 10-0864573 B1 | 10/2008 |
| KR | 10-0939661 B1 | 2/2010 |

OTHER PUBLICATIONS

Winchester Ammunition Products, "S410PDX1 Defender Shotshell Ammo," product page downloaded from the Internet on Apr. 11, 2025, at https://winchester.com/Products/Ammunition/Shotshell/Defender/S410PDX1 2 pp.

(Continued)

*Primary Examiner* — Derrick R Morgan
(74) *Attorney, Agent, or Firm* — Leydig, Voit & Mayer, Ltd.

(57) ABSTRACT

A cartridge for a firearm, including a projectile, a gas check, a case, a propellant, and a primer configured to ignite the propellant. The propellant is arranged between the gas check and an end surface of the case in which the primer is arranged. The case is crimped against the projectile. The case includes an open end with discrete roll crimps distributed along a circumference of the open end. The case further includes tapered crimps between the roll crimps along the circumference of the open and. The open end alternates between tapered and roll crimps along the entire circumference of the open end. Each of the roll crimps and tapered crimps are crimped to the projectile.

17 Claims, 13 Drawing Sheets

(56) References Cited

U.S. PATENT DOCUMENTS 703,840 A * 7/1902 Scott ..... F42B 5/03 102/438
1,376,530 A * 5/1921 Greener ..... F42B 5/03 102/438
1,834,377 A * 12/1931 Burghardt ..... F42B 7/08 28/116
1,840,843 A * 1/1932 Jacobs ..... F42B 7/08 106/164.01
1,908,314 A * 5/1933 Brownsdon ..... F42B 7/08 102/461
2,172,054 A * 9/1939 Di Brazza-Savorgnan ..... F42B 7/10 102/501
2,236,140 A * 3/1941 Kaleel ..... F42B 33/12 86/41
2,414,863 A * 1/1947 Foster ..... F42B 7/10 102/517
2,770,194 A * 11/1956 Kopf ..... B25C 1/163 411/440
3,048,077 A * 8/1962 Shelton ..... F42B 33/12 86/40
3,058,420 A * 10/1962 Tanner ..... F42B 7/10 102/439
3,062,145 A * 11/1962 Morgan ..... F42B 7/10 102/439
3,091,153 A * 5/1963 Roper ..... F42B 33/14 86/39
3,138,102 A * 6/1964 Meyer ..... F42B 12/34 102/509
3,313,202 A * 4/1967 Tuck ..... F42B 33/12 86/41
3,347,128 A * 10/1967 Bachhuber ..... F42B 33/12 86/39
3,398,682 A * 8/1968 Abela ..... F42B 7/10 102/439
3,862,600 A * 1/1975 Tocco ..... F42B 5/03 102/438
3,906,859 A * 9/1975 Smith ..... F42B 5/025 102/444
4,043,267 A * 8/1977 Hayashi ..... F42B 7/10 102/439
4,048,899 A * 9/1977 Bachhuber ..... F42B 33/12 86/39
4,063,511 A * 12/1977 Bullard ..... F42B 7/10 102/439
4,065,997 A * 1/1978 Allen ..... F42B 33/10 86/39
4,587,905 A * 5/1986 Maki ..... F42B 7/10 102/501
4,682,545 A * 7/1987 Jett, Jr. ..... F42B 5/36 102/501
4,805,536 A * 2/1989 Kosteck ..... F42B 12/78 102/514
4,864,934 A * 9/1989 Theising ..... F42B 7/08 102/501
5,079,986 A * 1/1992 Lee ..... F42B 33/005 86/39
5,225,628 A * 7/1993 Heiny ..... F42B 7/10 102/438
5,295,439 A * 3/1994 Carbone ..... F42B 5/03 102/438
5,408,931 A * 4/1995 Tallman ..... F42B 7/10 102/434
5,500,183 A * 3/1996 Noordegraaf ..... F42B 12/74 420/560
5,648,637 A * 7/1997 Clark, III ..... F42B 5/03 102/491
5,824,944 A * 10/1998 Dippold ..... F42B 12/74 102/501
6,257,149 B1 7/2001 Cesaroni
6,283,037 B1 * 9/2001 Sclafani ..... F42B 12/40 102/513
6,367,388 B1 * 4/2002 Billings ..... F42B 10/50 102/455
6,439,124 B1 * 8/2002 Enlow ..... F42B 12/74 102/501
6,536,352 B1 3/2003 Nadkarni et al.
6,539,873 B2 * 4/2003 Diller ..... F42B 7/04 102/458
7,194,960 B2 * 3/2007 Vasel ..... F42B 6/10 102/370
7,204,191 B2 4/2007 Wiley et al.
7,210,410 B1 * 5/2007 Widener ..... F42B 7/02 102/438
7,918,164 B1 4/2011 Eberhart
7,934,455 B2 * 5/2011 Winter ..... F42B 10/22 102/521
8,161,885 B1 4/2012 Emary
8,413,587 B2 4/2013 Emary
8,807,040 B2 * 8/2014 Menefee, III ..... F42B 5/03 102/460
9,103,640 B2 * 8/2015 Sexton ..... F42B 5/03
9,134,102 B2 9/2015 Flowers
10,222,183 B2 3/2019 Smith
11,085,745 B1 * 8/2021 Pierce, Sr. ..... F42B 7/10
11,105,597 B1 * 8/2021 Swanson ..... F42B 10/22
11,187,502 B1 * 11/2021 Menefee, III ..... F42B 5/24
11,879,715 B1 * 1/2024 Rogers ..... F42B 7/08
12,196,534 B1 * 1/2025 Unger ..... F42B 12/34
2003/0005846 A1 * 1/2003 Atwood ..... F42B 5/067 102/439
2006/0032392 A1 * 2/2006 Menefee ..... F42B 7/10 102/439
2007/0272113 A1 * 11/2007 Meyer ..... F42B 14/064 102/439
2010/0212533 A1 * 8/2010 Brunn ..... F42B 7/02 102/502
2010/0282110 A1 * 11/2010 Sexton ..... F42B 12/56 102/438
2011/0174186 A1 * 7/2011 Frank ..... F42B 7/10 102/460
2012/0085259 A1 * 4/2012 Cronemberger ..... F42B 8/12 102/444
2012/0234198 A1 * 9/2012 Carmel ..... F42B 30/02 102/438
2014/0130696 A1 * 5/2014 DeJong ..... F42B 7/10 102/448
2014/0190364 A1 * 7/2014 Peterson ..... F42B 14/064 102/439
2014/0261042 A1 * 9/2014 Imhoff ..... F42B 5/03 102/438
2015/0000545 A1 * 1/2015 Sorensen ..... F42B 5/03 102/439
2016/0273894 A1 * 9/2016 Amick ..... F42B 12/74
2017/0276463 A1 9/2017 Tubb et al.
2018/0356193 A1 * 12/2018 Yadon ..... F42B 12/367
2019/0293395 A1 * 9/2019 Yonashiro ..... F42B 33/12
2021/0270586 A1 * 9/2021 Maricaille ..... F42B 7/08
2022/0049937 A1 * 2/2022 Lowell ..... F42B 5/24
2023/0194221 A1 * 6/2023 Schmieg ..... F42B 7/06 102/449
2023/0228544 A1 * 7/2023 Walker ..... F42B 12/34 102/439

OTHER PUBLICATIONS

Hornady Manufacturing, Inc., "410 Triple Defense," product page downloaded from the Internet on Apr. 2, 2025 at https://www.hornady.com/ammunition/handgun/410-critical-defense-2-1-2#!/ 5 pp. (2025).

* cited by examiner

FIREARM CARTRIDGE WITH ROLL AND TAPERED CRIMPS AND RELATED METHODS FOR ASSEMBLY

FIELD

The present disclosure relates to a cartridge for a firearm with roll and tapered crimps and a method for producing such a cartridge.

BACKGROUND

Cartridges of varying size and shape are known in the art that are configured for use in firearms. Each cartridge typically includes a projectile, a propellant, and a primer arranged in a case. The cartridge is arranged either manually or mechanically in a chamber of a firearm. A firing pin of the firearm strikes the primer, thereby igniting the propellant and causing the projectile of the cartridge to be expelled from the firearm's barrel at a high velocity. Conventional cartridges, however, suffer from several drawbacks.

First, cartridges often have a projectile either partially or entirely composed of lead. Lead is known to be toxic to both humans and animals. In humans, lead is known in particular to have damaging neurological impacts, and lead projectiles thus pose a health risk even to persons who are not struck by the projectile. Outdoor shooting can also be hazardous to the environment, as lead projectiles can be scattered into animals, wildlife food sources, and/or water.

Second, cartridges usually include only one projectile. In a self-defense situation, single-projectile cartridges can be quickly depleted due to the fear and/or adrenaline experienced by a firearm user. Moreover, firearms include magazines with limited cartridge capacity, which can lead to a firearm user depleting all of their ammunition without hitting their target when they are under stress. For this reason, shotguns are sometimes preferred over rifles or handguns in self-defense applications. However, shotguns are cumbersome due to their large size and have an undesirably high potential to cause excessive damage at short range. Moreover, shotguns commonly do not include rifled barrels, and usually rely on a spread of projectiles rather than precisely striking a target.

Furthermore, self-defense firearms are often preferred in smaller form factors so that they may be concealed and maneuvered as easily as possible. As such, self-defense firearms often use lower pressure cartridges, such as those used in revolvers or semi-automatic pistols (e.g., .38 Special, 9 mm, 9 mm Parabellum, and the like). When hollow points are used in such cases, the hollow point projectile can inflict less damage to a target and function like a conical projectile. Wadcutter projectiles may be preferred in such cases, as they can cause more damage than conical bullets under such conditions. But wadcutters are generally known to fail to cycle or to "feed" into the chamber in semi-automatic handguns, such that few, if any, wadcutters are marketed for semi-automatic handguns.

Cartridges having more than one projectile are known in the art. However, such cartridges often rely on loose pellets or shot being packed into a cartridge, mimicking the firing pattern of a shotgun and having reduced accuracy and stopping power. Cartridges are also known that have larger spherical projectiles, similarly mimicking the firing pattern of a shotgun with projectiles at a larger scale. Other cartridges are also known that include multiple projectiles that are primarily configured to favor accuracy over projectile spread, and thus have projectiles of identical diameter within a casing.

Accordingly, improvements to cartridges are needed to address the foregoing drawbacks.

BRIEF SUMMARY

In accordance with embodiments of the present disclosure, cartridges for firearms and methods for assembling cartridges for firearms are provided.

In an aspect, the present disclosure provides a cartridge for a firearm, comprising a projectile, a gas check, a case, a propellant, and a primer configured to ignite the propellant. The propellant is arranged between the gas check and an end surface of the case in which the primer is arranged. The case is crimped against the first projectile. The case includes an open end with discrete roll crimps distributed along a circumference of the open end. The case further includes tapered crimps between the roll crimps along the circumference of the open and. The open end alternates between tapered and roll crimps along the entire circumference of the open end. Each of the roll crimps and tapered crimps are crimped to the projectile.

In another aspect, the present disclosure provides a method for assembling a cartridge for a firearm, the method comprising providing a cylindrical case with an open end, arranging a propellant in the case, and arranging a gas check, and a projectile in the case. The method further includes crimping the open end of the case against the projectile along an entire circumference of the open end such that the open end has discrete roll crimps distributed along the circumference of the open end and tapered crimps between the roll crimps. each of the roll crimos and tapered crimps being crimped to the projectile.

DETAILED DESCRIPTION

Surprisingly, it has been found that cartridges according to the present disclosure address the foregoing deficiencies associated with traditional cartridges, including cartridges that have a wadcutter projectile. It has also been found that multiple projectiles can be included in a single cartridge to increase the so-called "stopping power" (i.e., the propensity to stop a target from being a threat) of the cartridge by increasing the quantity of projectile impacts on a target, increasing the likelihood of one or more projectiles striking the target and, more significantly, the likelihood of striking a vital part of the target. It has also been found that cartridges with wadcutters are effective for self-defense applications, as wadcutters can provide visual feedback to a user upon striking a target and can be more effective than hollow points, which sometimes behave like conical projectiles in practice. Moreover, it has been determined that wadcutters do not split a target when creating a wound channel (e.g., by acting as a wedge between portions of the target upon impact) like conical projectiles or failed hollow points might, and that wadcutters instead cut and punch a target to form a hole with a more clearly defined and/or identifiable periphery in the target. Wadcutters can thus cause more tissue damage to a target than a failed hollow point or conical projectile.

The figures of the present disclosure with line drawings are understood to be schematic illustrations, and thus do not limit the scale or proportion of components illustrated therein.

Figure 1A:
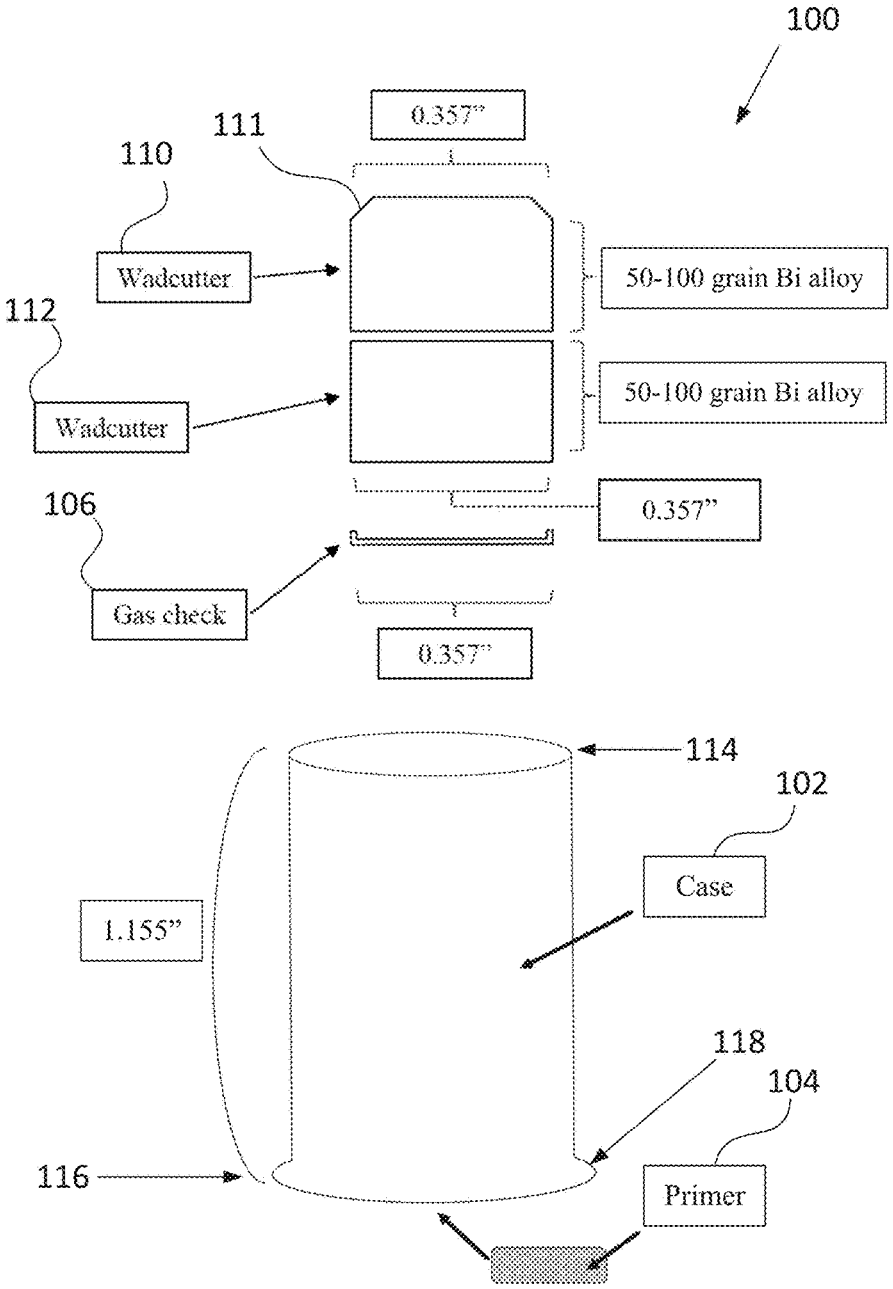
FIGS. 1A-1C schematically illustrate cartridges with multiple wadcutter projectiles.

FIG. 1A schematically illustrates a cartridge 100 having a case 102 (also referred to herein as a "casing" or a "shell"), a primer 104, gas check 106, a first projectile 110, and a second projectile 112. The case has a first end 114 that is open and a second end 116 that is substantially closed. As described in the present disclosure, the terms "case," "casing," and "shell" refer to metal jacketed cartridges instead of non-metal cartridges (e.g., shotgun shells), with the distinction that cases according to the present disclosure are configured to be crimped directly onto and circumferentially around at least one projectile rather than merely carrying projectiles entirely within the interior of a cartridge. Moreover, cartridges according to the present disclosure are configured for rifled barrels such that projectiles of the cartridges engage with barrel rifling for increased shooting accuracy. In some embodiments, at least one projectile of a cartridge can have a reduced diameter in order to reduce the projectile's engagement with a barrel's rifling, thereby promoting projectile spread and reducing the accuracy of the reduced diameter projectile. In contrast to conventional solutions, which include using pellets or equally shaped projectiles of equal mass (e.g., as commonly utilized in shotgun shells), the present disclosure provides metal jacketed rounds in which spread is deliberately caused in a controlled manner to strike a target, by seating two or three projectiles within a casing and in some cases by changing the diameter of one or more of the projectiles relative to the others in order to predictably control projectile spread. It will also be readily understood that in contrast to shotgun or other self-defense cartridges that utilize spherical projectiles, the present disclosure is directed to projectiles with a cylindrical body in order to ensure engagement of the projectile with barrel rifling and for proper crimping of the projectiles within a metal casing.

The primer 104 is arranged in the second end 116 of the case 102 and is configured to ignite upon being struck by a firing pin of a firearm. The primer can be a centerfire primer or a rimfire primer. The primer can include a brass cup filled with a mixture of barium nitrate, diazodinitrophenol, nitrocellulose, tetrazene, and/or one or more of the following: Pentaerythritol tetranitrate (PETN), aluminum, and antimony sulfide. A propellant (e.g., smokeless powder, black powder substitute, black powder, or the like) is arranged in an internal cavity of the case 102 via the open first end 114. The propellant can include a smokeless powder of either a single base (nitrocellulose) or double base (nitrocellulose and nitroglycerine) with or without other components, but excluding lead. The amount of propellant included in the cartridge 100 can vary depending on the caliber of the cartridge. For example, for a .38 Special (which corresponds to the particular dimensions of the case 100 as illustrated in FIG. 1A), about 6.0 grains of smokeless powder can be used. In some embodiments, from 3.2 to 4.4 grains of commercially available powders such as Bullseye® powder can be used. In another example, for higher calibers, such as a .45 ACP, 5.9 to 6.6 grains of smokeless powder can be used. Although specific primers and propellants are described above for illustrative purposes, embodiments of the present disclosure can include conventional primers and propellants, as well as conventionally recognized quantities of propellant. For example, propellant compositions and quantities configured to match safety standards (taking roughly into consideration the total weight of multiple projectiles, rather than one, in any given cartridge) set by the Sporting Arms and Ammunition Manufacturing Institute (SAAMI) and/or performance criteria utilized by the Federal Bureau of Investigation (FBI) can be used.

The gas check 106 is arranged in the case 102 such that the propellant is between the gas check 106 and the second end 116. The gas check 106 has a thin-walled cup-like shape and partially surrounds one end of the second projectile 112. The gas check is configured to improve projectile firing accuracy by enhancing projectile engagement with barrel rifling. Gas checks can be made of brass, and do not necessarily need to be included for some cartridges according to the present disclosure to properly function. Gas checks can also prevent projectile deformation for hot loads, even if they are not necessarily required for proper seating and firing of multiple projectiles from a single cartridge. However, in cartridges according to the present disclosure that include a reduced diameter second projectile (as will be described in detail hereafter), a gas check is preferred to properly seat the reduced diameter second projectile, as it has been found by the inventor that projectile deformation and accuracy is improved when a gas check is included to properly seat the second projectile of reduced diameter versus similarly configured cartridges that do not include a gas check.

The second end 116 includes a rim 118 that protrudes radially outward from the rest of the case 102. The rim 118 provides a space for an extractor in a firearm to grip the case 102 and thereby remove it from a chamber of the firearm once the cartridge 100 is fired (and the first and second projectiles 110, 112 are thereby expelled from within the case 102).

The second projectile 112 is arranged in the case 102 such that the gas check 106 is between the second projectile 112 and the propellant. The second projectile 112 is thus arranged entirely in the case 102 when the cartridge 100 is fully assembled. The second projectile 112 is configured as a wadcutter, thereby decreasing the amount of space between the first projectile 110 and the second projectile 112 in a fully assembled cartridge 100. The first projectile 110 is arranged within the case 102 such that when the case 102 is crimped closed against the first projectile 110 (via a roll crimp), the exposed front surface of the first projectile 110 protrudes from the first end 114 of the case 102. The first projectile 110 is arranged partially within the case 102 and partially protruding from the case 102. The first projectile is also configured as a wadcutter or as a semi-wadcutter (e.g., a wadcutter with sloped edges). The fully assembled cartridge 100 should not exceed the length of a cartridge of corresponding caliber as set forth by industry standards. For example, in the case of a .38 Special, the cartridge should not exceed a length of 1.550 inches. All given case lengths (in the illustrated embodiment and in embodiments illustrated and described hereafter) may vary slightly as long as they do not exceed the length of a cartridge of a corresponding caliber as set forth by industry standards.

The first and second projectile 110, 112 can have the same shape and/or can be identical and interchangeable with one another during assembly of the cartridge 100. In some embodiments, the first and second projectile 110, 112 can have different shapes and/or configuration. For example, the first projectile 110 can have chamfered edges 111 (thereby forming a semi-wadcutter), whereas the second projectile 112 can exclude such chamfered edges. This optimizes the aerodynamic performance of the first projectile 110 and thereby the accuracy of the first projectile when it is fired. The foregoing also aids in loading the cartridge 100 into a revolver. By eliminating chamfered edges from the second projectile 112, the aerodynamic performance of the second projectile 112 can be reduced slightly in favor of providing a decreased gap between the first projectile 110 and second projectile 112 in an assembled cartridge 100. This ensures that the second projectile 112 does the least amount of damage to the first projectile 110 by increasing the surface area over which forces from the second projectile 112 are exerted onto the first projectile 110. Moreover, the non-chamfered shape of the second projectile 112 reduces the likelihood of play of the first and/or second projectile 110, 112 within the case 102 when the cartridge 100 is fully assembled. In some embodiments, the second projectile 112 can have a diameter that is slightly smaller than the diameter of the first projectile 110. This increases the propensity of the projectiles to spread as they are expelled from a firearm to create separate wound channels in a target for self-defense applications. The first and second projectiles 110, 112 can be configured to remain intact upon impact with a target.

The first and second projectiles 110, 112 can have the same material composition. For example, both the first and second projectile 110, 112 can comprise a bismuth alloy. Whereas conventional cartridge projectiles include lead, both the first and second projectile 110, 112 according to the present disclosure can include no lead, and thereby eliminate the use of lead in the cartridge 100 entirely. The cartridge 100 is thus more environmentally friendly and less hazardous in terms of unintended and long-term adverse health effects. Moreover, the risk of lead toxicity resulting from manufacturing or handling of the cartridge 100 can be eliminated. The first and second projectiles 110, 112 can each have a weight of between 50-100 grains. In some embodiments, the first and second projectiles 110, 112 can have different weights relative to one another. For example, one projectile can be 50 grains and the other can be 100 grains. In some embodiments, the use of lead can be reduced, but not eliminated, by instead configuring the projectiles 110, 112 to have lead cores and total copper jackets, thereby encasing the lead to reduce the likelihood of lead exposure while taking advantage of the low material cost of lead. In some embodiments, the projectiles 110, 112 can be made entirely of copper.

In the illustrated embodiment, the first and second projectiles 110, 112 and the gas check 106 each have a diameter of between about 0.354 to 0.357 inches and the case 102 has a length of about 1.155 inches. The cartridge 100 can thus be configured as a .38 Special cartridge. Because the outer dimensions of the cartridge 100 are consistent with those used within industry for a .38 Special, the cartridge 100 is compatible with firearms designed for .38 Special cartridges. It will be readily understood that the diameter of the first and second projectiles 110, 112 could deviate from the illustrated embodiment between 0.354 and 0.357 inches. Moreover, if the first and second projectiles have a larger diameter within the range, the gas check 106 can be excluded without departing from the spirit of the present disclosure. It will also be readily understood, however, that the cartridge 100 and its constituent components can have varying diameters for use in firearms of varying size without departing from the spirit of the present disclosure. For example, dimensions of the components illustrated in FIG. 1A can be changed for a 0.44 Smith & Wesson (S&W) special caliber cartridge by providing projectiles and a gas check that are instead between 0.427 and 0.430 inches in diameter, with projectiles having a weight of 50-112 grains, and a case that has a length of 1.160 inches. Other dimensional modifications can be made to conform the illustrated embodiment with different calibers, as shown hereafter in Table 1.

Figure 2A:
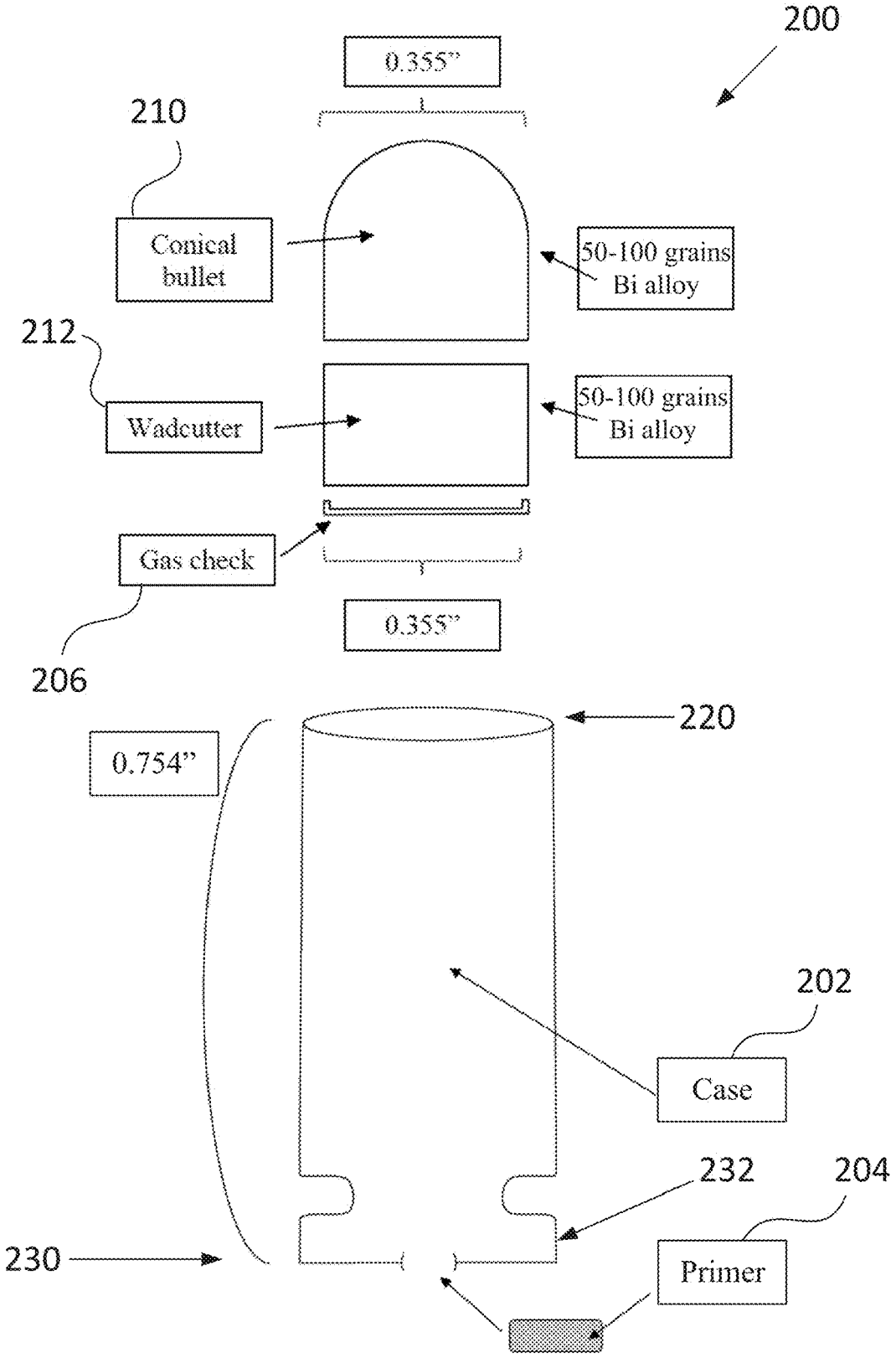
FIGS. 2A and 2B schematically illustrate cartridges with a wadcutter projectile and a conical projectile.
Figure 2B:
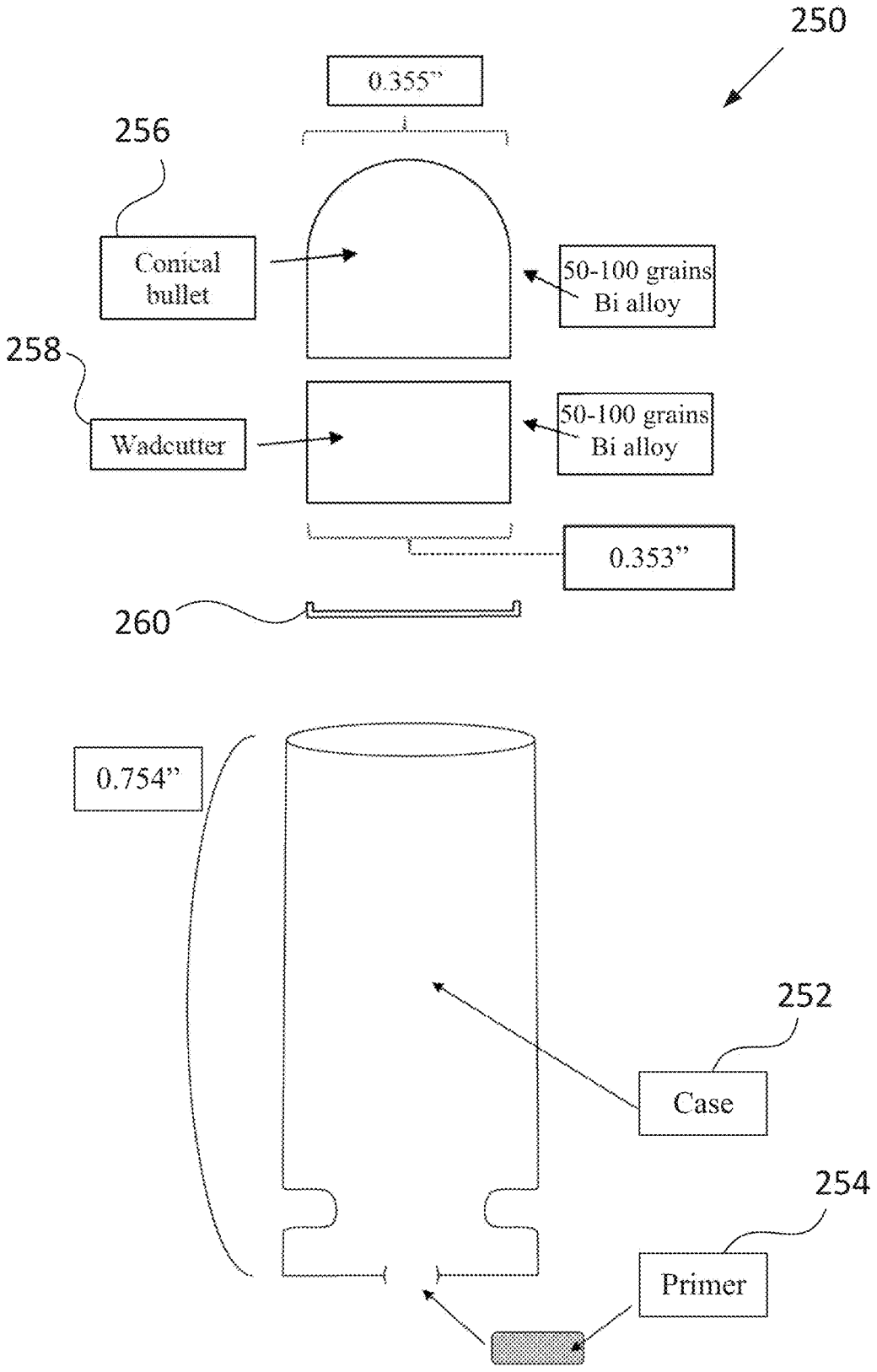

A further advantage of cartridge 100 is that due to the inclusion of more than one projectile, the probability of a single cartridge resulting in multiple strikes on a target (and in particular, the vital part or parts of the target) is increased. In jurisdictions having restrictions on the number of cartridges that may be carried with a firearm or loaded in a magazine, cartridges according to the present disclosure double the number of projectiles that can be fired under such restrictions. Moreover, because two projectiles are included, more than one wound channel can be inflicted on a target, thereby increasing the lethality and/or damage potential of the cartridge. If projectiles having differences in shape and/or configuration are included (e.g., as illustrated in FIGS. 2A and 2B and described further herein), the wound channels created in the target can also be different. For semi-automatic firearms, cartridges with a conical leading projectile can preferably be used to ensure smooth cycling of the cartridge in the firearm while a wadcutter is used for a second projectile to inflict more damage to a target. An additional advantage of the cartridge 100 is that multiple projectiles can be accommodated in a cartridge without the need for additional fittings or materials that would increase cartridge complexity and thereby increase its cost. In fact, additional fittings or materials between the first and second projectiles 110, 112 can be completely avoided for the purpose of increasing cartridge simplicity, thereby increasing cartridge reliability and reducing the likelihood of projectile accuracy being detrimentally affected by the inclusion of such further fittings or materials.

Figure 1B:
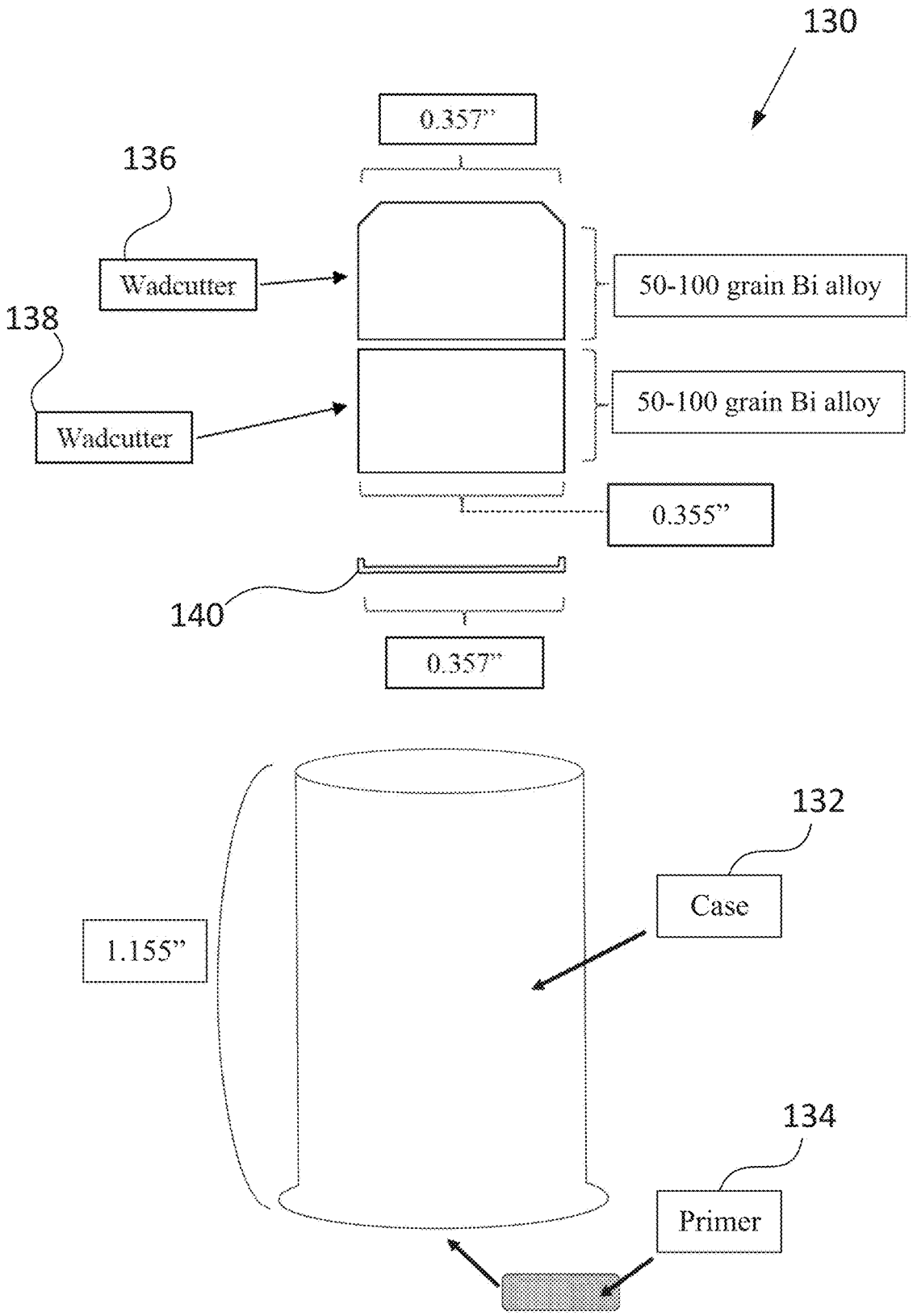

FIG. 1B schematically illustrates a cartridge 130 having a case 132, a primer 134, gas check 140, a first projectile 136, and a second projectile 138. The cartridge 130 is substantially similar to the cartridge 100 as illustrated in FIG. 1A and described above, except that the first and second projectiles 136, 138 are not identical in size. Instead, the second projectile 138 has a smaller diameter of 0.355 inches than the first projectile 136, which has a diameter of 0.357 inches. This causes the first and second projectiles to have a greater spread in trajectory, as will be described in greater detail hereafter. The second projectile 138 can also be modified to have an even smaller diameter of 0.354 inches for greater spreading effect. As with FIG. 1A, it will be readily understood that the particular dimensions illustrated and described with regard to FIG. 1B can be adjusted for compatibility with other standard calibers. For example, the diameter of the first projectile 136 can be adjusted according to the standard diameter for projectiles of a different caliber and the second projectile 138 can be modified to have a diameter of 0.001 to 0.003 inches less than the diameter of the first projectile 136.

Figure 1C:
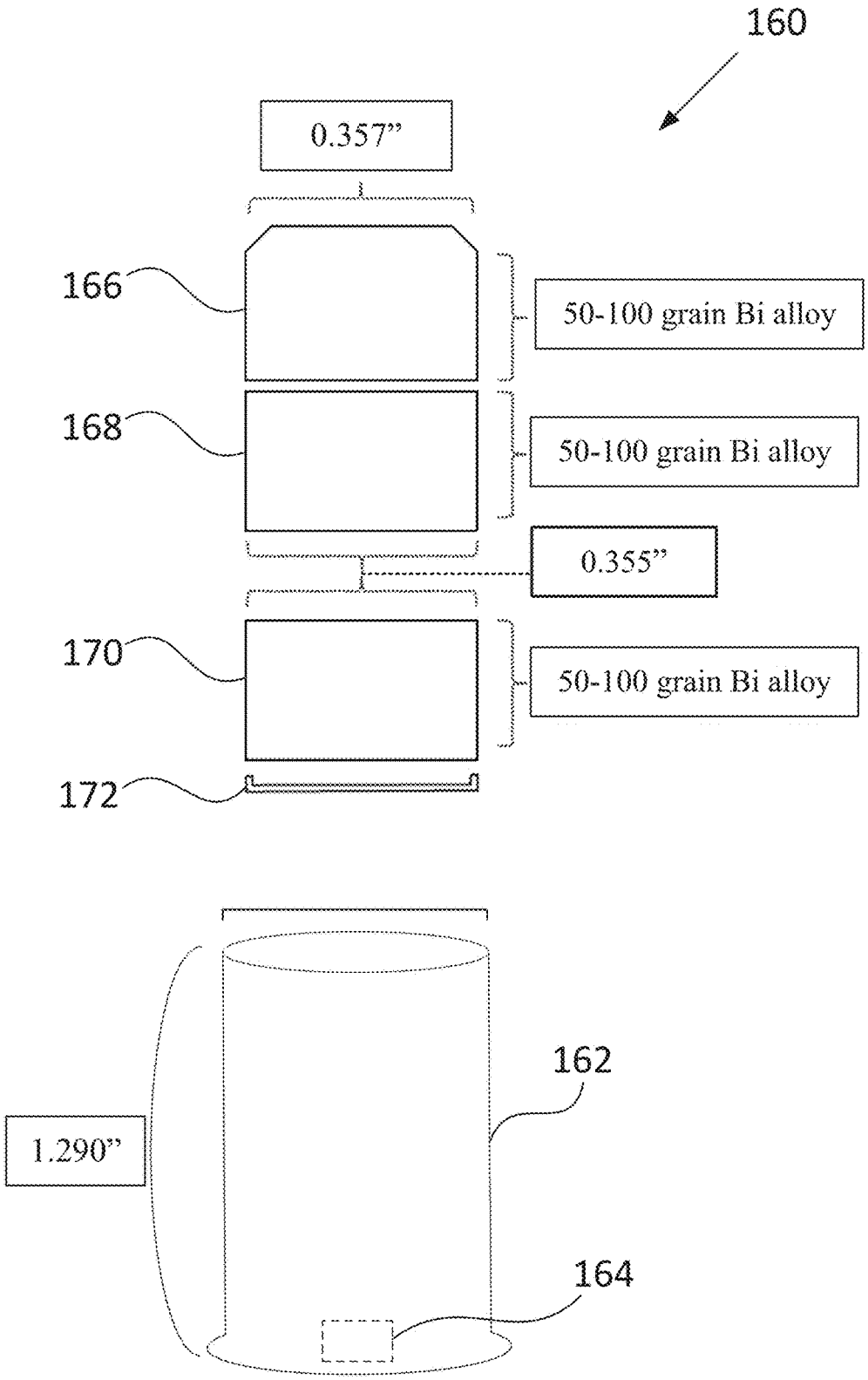

FIG. 1C schematically illustrates a cartridge 160 having a case 162, a primer 164, a gas check 172, a first projectile 166, a second projectile 168, and a third projectile 170. The cartridge 160 is substantially similar to that of FIGS. 1A and 1B, except that three projectiles are included instead of two, and the second and third projectiles 168, 170 have smaller diameters than the first projectile 166. Instead, the second and third projectiles 168, 170 each have a diameter of 0.355 inches, and the first projectile 166 has a diameter of 0.357 inches. In some embodiments, the second and third projectiles 168, 170 can be modified to have an even smaller diameter of 0.354 inches for an increased spreading effect. The cartridge 160 is configured as a .357 Magnum caliber cartridge such that the case 162 has a length of 1.290 inches and an open-end diameter of 0.379 inches . . . 357 Magnum cartridges are often not considered ideal for self-defense applications, as the recoil is so powerful that it takes too long to reposition a firearm for a subsequent shot. Surprisingly, however, it has been discovered that with a cartridge according to the present disclosure, the propellant in a .357 Magnum cartridge can be reduced slightly to allow all three projectiles to strike a target without over-penetration. The projectiles 166, 168, 170 can have a weight of 50-100 grains. In an embodiment, one or more of the projectiles can have different weights relative to the others. For example, one or more of the projectiles can have a weight of 50 grains and the other(s) can have a weight of up to 100 grains.

FIG. 2A schematically illustrates a cartridge 200 with a first projectile 210 configured as a conically-shaped projectile and the second projectile 212 configured as a wadcutter. The cartridge 200 includes a case 202 having a first end 220 and a second end 230. The primer 204 is arranged in the second end 230 of the case 202 and is configured to ignite a propellant. The case 202 includes a rim 232 at the second end 230. The rim 232 is formed in part by an adjacently arranged circumferential recess 234 that extends radially inward about an entire outer circumference of the case 202. The rim 232 provides space for an extractor in a firearm to grip the case 202 and thereby remove it from a chamber of the firearm once the cartridge 200 is fired (and the first and second projectiles 210, 212 are thereby expelled from within the case 202).

The arrangement of the first and second projectiles 210, 212 and gas check 206 within the case 202 is comparable to that of the cartridge 100 in FIG. 1A. However, unlike cartridge 100, the cartridge 200 as illustrated in FIG. 2A includes a conical first projectile 210. Although the first projectile 210 has a domed shape, it will be readily appreciated that FIG. 2A is schematic only and does not precisely illustrate the only possible shape that the first projectile 210 can have. For example, the first projectile 210 have a pointed conical shape as opposed to a domed conical shape without departing from the spirit of the present disclosure. A conical first projectile 210, however, is advantageous for use in semi-automatic handguns to prevent firearm jamming while cartridges are being cycled through a chamber. In some embodiments, the first projectile 210 can be configured as a semi-wadcutter, or as a hollow point projectile, thereby causing the first projectile 210 to expand upon impact with a soft target to increase the performance of the cartridge in a self-defense situation.

In the illustrated embodiment, the first and second projectiles 210, 212 and the gas check 206 have an outer diameter of about 0.355 inches and the case 202 has a length of about 0.754 inches. The cartridge 200 can thus be optimally configured as a 9 mm caliber cartridge. For example, the cartridge 200 can be configured to comply with The North Atlantic Treaty Organization (NATO) requirements for 9 mm cartridges. The first and second projectiles 210, 212 can each have a weight of about 50-100 grains. The first and second projectiles 210, 212 can have different weights relative to one another. For example, one projectile can have a weight of 50 grains and the other can have a weight of 90-100 grains. In an embodiment, the first and second projectiles 210, 212 can have a more specific weight of between 50-78 grains. In some embodiments, to comply with NATO requirements, the first and second projectiles 210, 212 can have the same diameter and weight in order to prioritize projectile accuracy.

It will be readily appreciated that the foregoing projectile weights and the sizes of the projectiles and case can be varied to a different caliber or for fitment to varying firearm chambers without departing from the spirit of the present disclosure. For example, in some embodiments the cartridge 200 can be configured for a 10 mm caliber with a case 202 having a diameter of 0.423 inches and a length of 0.992 inches, and projectiles 210, 212 having an outer diameter of 0.400 inches and a weight of from 50 to 112 grains each. In some embodiments, the cartridge can be configured such that the first projectile 210 has an outer diameter of 0.400 inches and the second projectile 212 has an outer diameter of 0.397 to 0.399 inches, or preferably 0.398 inches. In some embodiments, the cartridge 200 can be configured as a 0.40 S&W cartridge with a case 202 having a first end 220 diameter of 0.423 inches and a length of 0.850 inches, and projectiles 210, 212 having an outer diameter of 0.400 inches and a weight of from 50-112 grains each. In some embodiments, the cartridge 200 can be configured as a .45 Automatic Colt Pistol (ACP) cartridge with a case 202 having a first end 220 diameter of 0.473 inches and a length of 0.898 inches, and projectiles 210, 212 having an outer diameter of 0.451 inches and a weight of from 50 to 112 grains each.

The first and second projectiles 210, 212 can be composed of the same or different materials. For example, both the first projectile 210 and the second projectile 212 can include a bismuth alloy and can thereby provide for a cartridge 200 that is lead-free. The bismuth alloy can contain, for example, 87.25% by weight bismuth, 12% tin, and 0.75% antimony. In some embodiments, the bismuth alloy can include 87.37% by weight bismuth, 11.89% tin, and 0.74% antimony. In some embodiments, the projectiles 210, 212 can include lead cores with copper jackets (e.g., a total metal jacket), thereby reducing the propensity for the projectiles to foul the barrel of a firearm and reducing projectile costs while still reducing the potential for lead to be exposed to the environment. In some embodiments, the primer 204 can be configured as a lead-free primer to protect users from lead exposure.

FIG. 2B schematically illustrates a cartridge 250 having a case 252, a primer 254, gas check 260, a first projectile 256, and a second projectile 258. The cartridge 250 is substantially similar to the cartridge 200 as illustrated in FIG. 2A and described above, except that the first and second projectiles 256, 258 are not identical in size. Instead, the second projectile 258 has a smaller diameter of 0.353 inches than the first projectile 256, which has a diameter of 0.355 inches. This causes the first and second projectiles to have a greater spread in trajectory, as will be described in greater detail hereafter. In some embodiments, the second projectile 258 can be modified to have an even smaller diameter of 0.352 inches for greater spreading effect. If configured as a .45 ACP cartridge, the second projectile can instead have an outer diameter of 0.448 to 0.451 inches, preferably 0.449 inches, to encourage projectile spread and create multiple wound channels in a target. Detailed dimensional information regarding the foregoing calibers and additional calibers compatible with the embodiment illustrated in FIGS. 2A-2B (as well as the embodiments in FIGS. 1A-1C and 3A-3B as described hereafter) are shown in Table 1 hereafter.

Figure 3A:
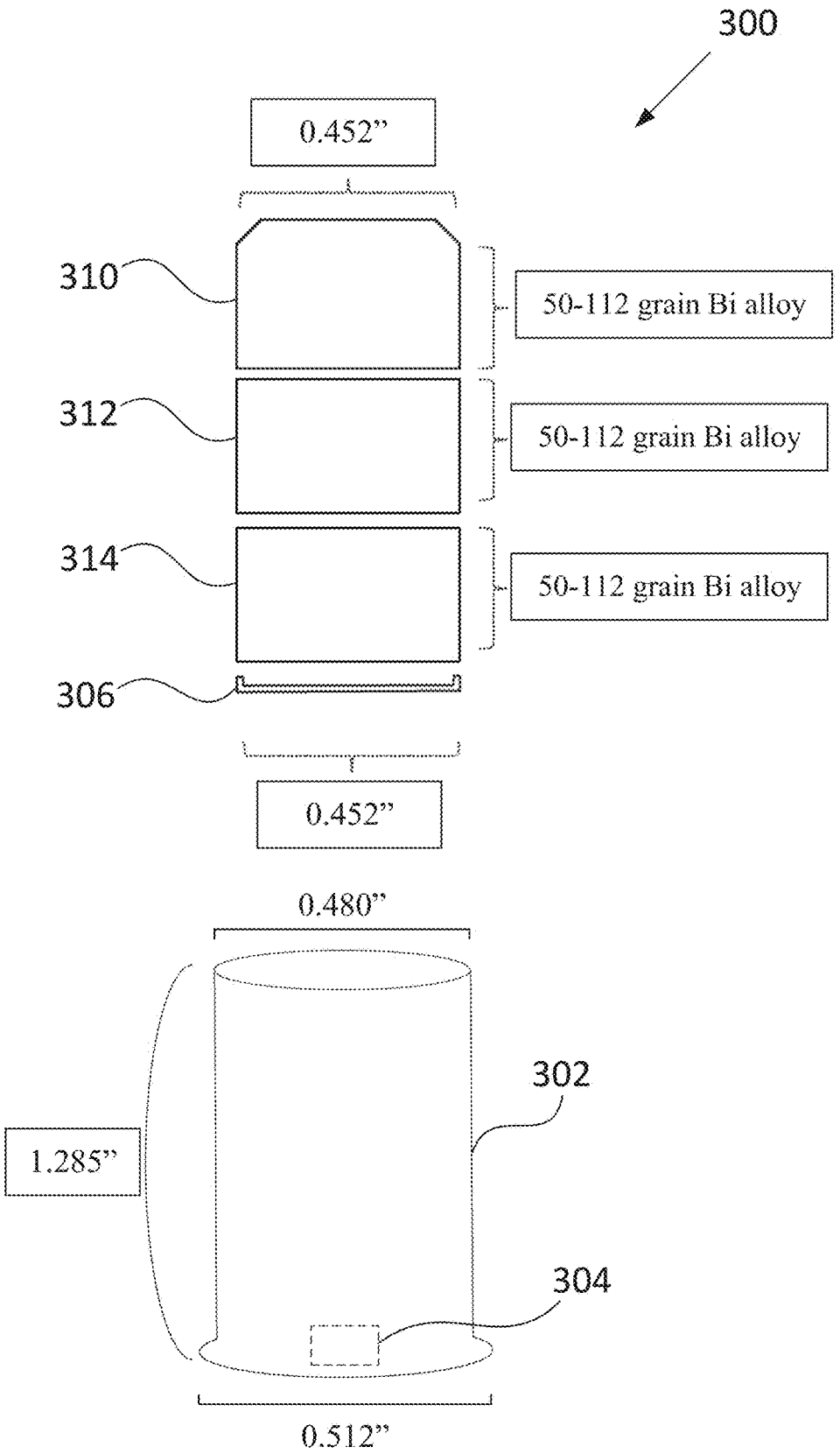
FIGS. 3A and 3B schematically illustrate .45 Colt and .45 ACP cartridges, respectively.

FIG. 3A schematically illustrates a cartridge 300 with three projectiles 310, 312, 314. The cartridge 300 includes a case 302, a primer 304, a gas check 306, a first projectile 310, a second projectile 312, and a third projectile 314. In the illustrated embodiment, the case 302 has an open-end diameter of about 0.480 inches and a length of about 1.285 inches. The three projectiles 310, 312, 314 and the gas check 306 have an outer diameter of about 0.452 inches. The cartridge 300 is thus configured as a .45 Colt (also known as a .45 Long Colt) cartridge. The three projectiles 310, 312, 314 can each have a weight of from 50-112 grains.

In some embodiments, the dimensions illustrated in FIG. 3A can be modified to embody a .44 Magnum cartridge. For example, while the general configuration of the cartridge 300 as including a case 302 with three projectiles 310, 312, 314 remains the same, the case open-end diameter can be modified 0.456 inches while maintaining a max case length of 1.285 inches. The first projectile 310, second projectile 312, and third projectile 314 can have diameters of 0.430, 0.427-0.430, and 0.427-0.430, respectively. Each projectile can have a weight of from 50 to 112 grains. In comparison with, for example, a somewhat similar .44 S&W Special cartridge having projectiles of similar weight and dimension (though a different quantity of projectiles), a .44 Magnum cartridge may include more powder to compensate for the increased total weight of projectiles.

In an embodiment, the cartridge 300 can include projectiles that are not identical in diameter. For example, similar to the differences illustrated between cartridges 100 and 130 of FIGS. 1A and 1B or similar in general to the configuration illustrated in FIG. 1C, the cartridge 300 can be modified such that the second and third projectiles 312, 314 have a smaller diameter of 0.450 to 0.451 inches compared to the first projectile 310 with a diameter of 0.452 inches. This causes the first and second projectiles to have a greater spread in trajectory, as will be described in greater detail hereafter. The second and third projectiles 312, 314 can also be modified to have an even smaller diameter of 0.449 inches for greater spreading effect.

Figure 3B:
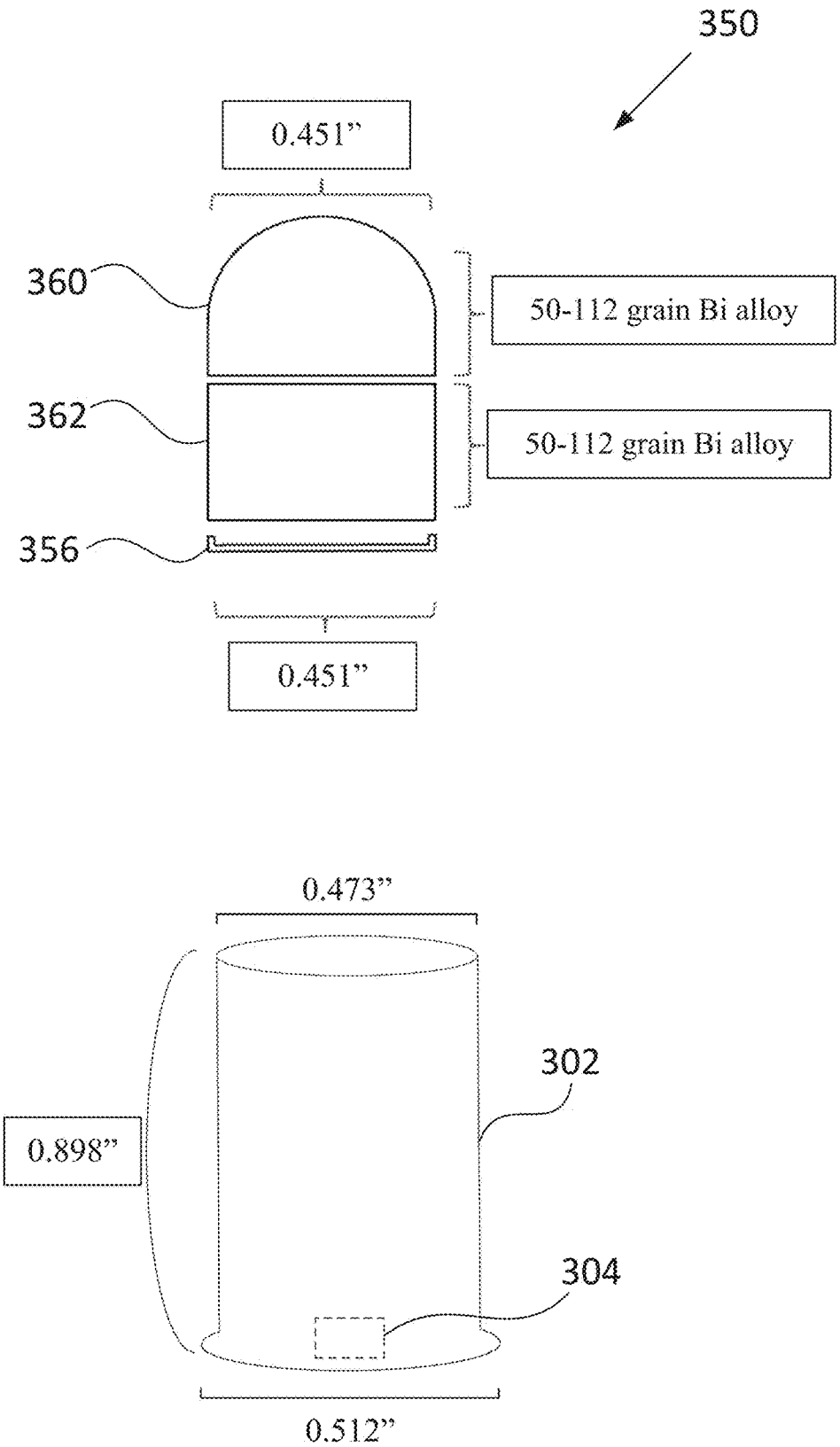

FIG. 3B schematically illustrates a cartridge 350 with two projectiles 360, 362 and a gas check 356. The cartridge 350 can include a similar case to that of cartridge 300. However, the cartridge 350 can be configured as a .45 ACP with a case length of 0.898 inches. The two projectiles 360, 362 can have a weight of from 50 to 112 grains. The first projectile 360 is conical with a 0.451 inch diameter and the second projectile 362 can be configured as a wadcutter with a diameter of 0.451 inches.

In an embodiment, the cartridge 350 can include projectiles that are not identical in diameter. For example, the cartridge 350 can be modified such that the second projectile 362 has a smaller diameter of 0.449 inches compared to the first projectile 360 with a diameter of 0.451 inches. This causes the first and second projectiles to have a greater spread in trajectory, as will be described in greater detail hereafter. In some embodiments, the second projectile 362 can be modified to have an even smaller diameter of 0.448 inches for greater spreading effect.

It will be readily understood that while specific calibers and dimensions have been illustrated and described with reference to FIGS. 1-3B, different calibers and dimensions of a cartridge can be provided without departing from the spirit of the present disclosure. For example, any cartridge of any caliber can be configured to include two projectiles as illustrated in FIGS. 1A, 1B, 2A, 2B, and 3B, and any cartridge of any caliber can be configured to include three projectiles as illustrated in FIGS. 1C and 3A. Accordingly, the features described herein can be incorporated in any jacketed cartridge of any caliber to include multiple projectiles and achieve corresponding advantageous effects as disclosed herein, provided that outer dimensions of cartridge casings and projectiles comply with conventional and industrial standards for cartridge dimensions. The use of conventional external dimensions to comply with industry standards for caliber dimensions ensures that embodiments of the present disclosure are compatible with well-established dimensions and tolerances for currently available firearms. Moreover, regardless of the caliber of the cartridge modified in accordance with the present disclosure, a universally observed advantage of cartridges according to the present disclosure is that a firearm itself does not need to be modified in order to cycle and fire cartridges according to the present disclosure. For example, a firearm can fire conventional cartridges of its designed caliber and also fire cartridges according to the present disclosure in rapid succession without any physical change or modification to the firearm. A firearm user can thus switch between cartridges according to need and/or preference quickly and safely without any additional effort expended toward configuring or modifying the firearm. Moreover, the cartridges according to the present disclosure can be fired in existing firearms that are already accessible and/or commercially available.

The precise dimensions and weights of projectiles for the cartridges illustrated and described above with reference to FIGS. 1A-3B can also be modified without departing from the spirit of the present disclosure. For example, in some embodiments, the first or leading projectile can have a larger diameter than subsequent projectiles arranged in a given cartridge. As described above with reference to FIGS. 1B, 1C, and 2B, this can lead to increased spread among the trajectories of projectiles. In general, projectiles arranged between the lead projectile and the primer of a cartridge can have a diameter that is 0.002 to 0.003 inches less than the lead projectile in order to observe such advantageous projectile spread when fired.

Table 1 includes dimensions for cases and projectiles of varying conventionally-recognized calibers according to the present disclosure. In particular, Table 1 lists the length and open-end diameter of cases for varying calibers, as well as projectile dimensions and weights for the varying calibers. In calibers that can more readily be modified to include a third projectile, Table 1 also lists diameters for a third projectile. Table 1 includes data for 9 mm, .357 Magnum, .38 Special, 10 mm, .40 S&W, .44 S&W Special, .44 Magnum, .45 Long Colt, and .45 ACP calibers. It will be readily appreciated that cartridges according to the present disclosure can be modified in accordance with other conventionally recognized calibers that are not listed below without departing from the spirit of the present disclosure. Generally, the case length, case open-end diameter, and first projectile diameter should comply with dimensional tolerances with a conventional caliber to ensure compatibility. The case length represents a maximum length. Accordingly, embodiments of the present disclosure may vary from the case length included in Table 1 without departing from the spirit of the disclosure, as long as the case length does not exceed the maximum case length. The second and/or third projectile, however, can have a diameter that is decreased by 0.001 to 0.003 inches in order to increase the spreading effect of the projectiles when fired. The projectile weights can also be modified in order to account for the presence of multiple projectiles and to balance firing accuracy and spreading effect to achieve increased cartridge stopping power. It will be readily appreciated that the precise values and ranges included in Table 1 are exemplary and represent values for optimized precision and spread of projectiles for self-defense applications. However, minor deviations from the values and ranges in Table 1 are possible without departing from the spirit of the present disclosure. For example, in some embodiments, a cartridge can include a second projectile that has a diameter even smaller than 0.003 inches less that of the first projectile in order to more significantly increase projectile spread. Moreover, minor variations in case length and open-end diameter are feasible while maintaining function of the multiple projectile cartridges as described herein.

TABLE 1

| Caliber | Case Length (inches) | Case Open-end Diameter (inches) | Projectile Diameters (inches) | Projectile Weight (grains) |
|---|---|---|---|---|
| 9 mm | 0.754 | 0.380 | First projectile: 0.355<br>Second projectile: 0.352-0.355 | 50-100 each |
| .357 Magnum | 1.290 | 0.379 | First projectile: 0.357<br>Second projectile: 0.354-0.357<br>Third projectile: 0.354-0.357 | 50-100 each |
| .38 Special | 1.155 | 0.379 | First projectile: 0.357<br>Second projectile: 0.354-0.357 | 50-100 each |
| 10 mm | 0.992 | 0.423 | First projectile: 0.400<br>Second projectile: 0.397-0.400 | 50-112 each |
| .40 S&W | 0.850 | 0.423 | First projectile: 0.400<br>Second projectile: 0.397-0.400 | 50-112 each |
| .44 S&W Special | 1.160 | 0.456 | First projectile: 0.430<br>Second projectile: 0.427-0.430 | 50-112 each |
| .44 Magnum | 1.285 | 0.456 | First projectile: 0.430<br>Second projectile: 0.427-0.430<br>Third projectile: 0.427-0.430 | 50-112 each |
| .45 Long Colt | 1.285 | 0.480 | First projectile: 0.452<br>Second projectile: 0.449-0.452<br>Third projectile: 0.449-0.452 | 50-112 each |
| .45 ACP | 0.898 | 0.473 | First projectile: 0.451<br>Second projectile: 0.448-0.451 | 50-112 each |

Figure 4:
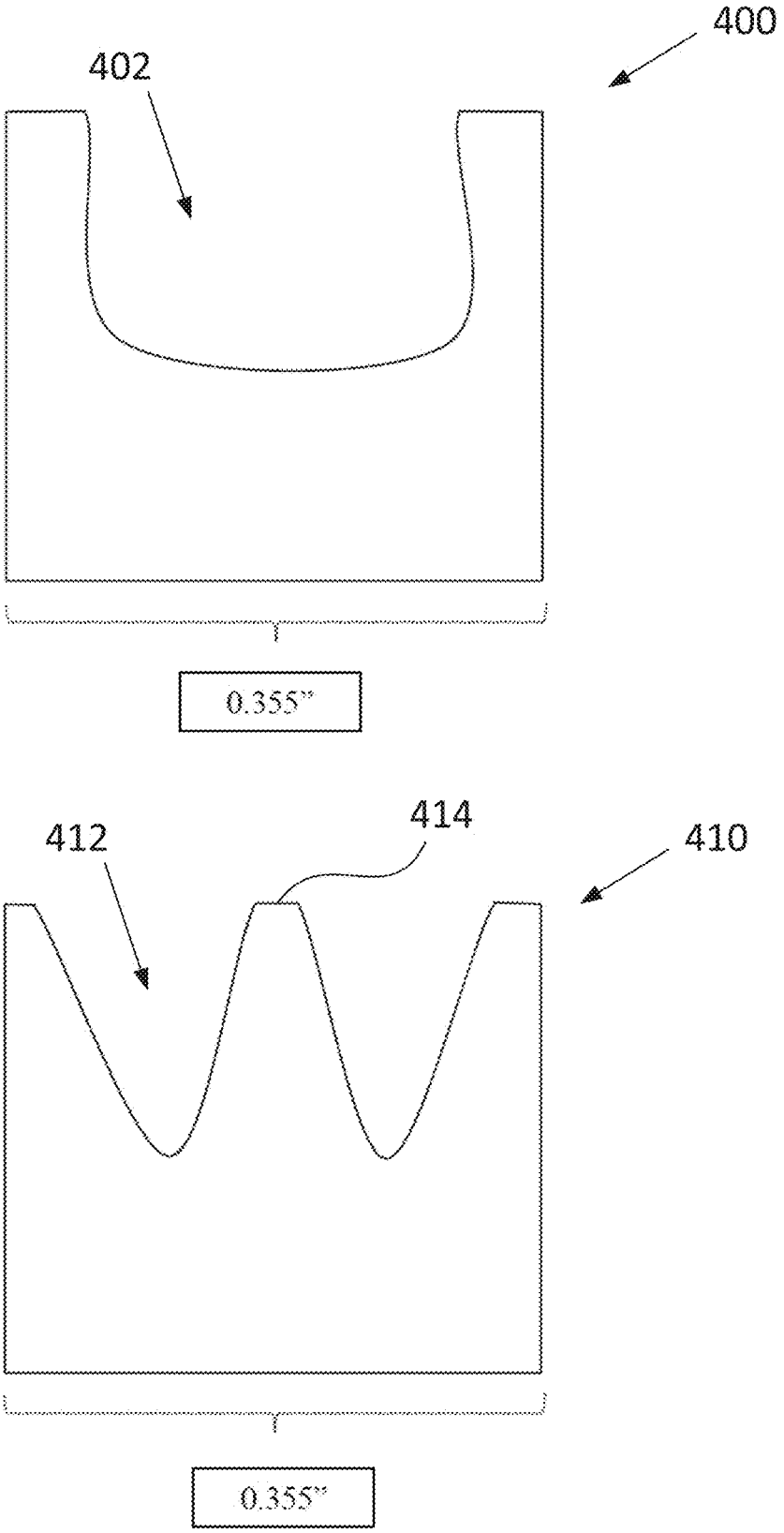
FIG. 4 illustrates varying internal cavity profiles of projectiles.

FIG. 4 illustrates cross sections of projectiles 400, 410 having different cavities 402, 412. A first expansion projectile 400 can be configured generally as a wadcutter hollow point projectile and includes an exterior cavity 402. The exterior cavity 402 has a generally consistent depth, thereby forming a contiguous wall about a circumference of the projectile 400. This causes the circumferential wall of the projectile 400 to be the first point of contact of the projectile 400 as it strikes a target. The exterior cavity 402 also causes a mass of the projectile to be arranged opposite the exterior cavity 402 with respect to a center of mass, thereby causing the projectile to spread radially outward upon impact with a target.

A second expansion projectile 410 is also configured as a wadcutter hollow point and includes an annular cavity 412 surrounding a central post 414. The second expansion projectile 410 is configured such that upon its impact with a target, the central post 414 penetrates the target and the annular cavity 412 facilitates deformation of the circumferential wall of the projectile radially outward. The post can also prevent distortion of second projectile.

The projectiles 400, 410 of FIG. 4 can be used as leading projectiles (e.g., the first projectiles as illustrated and described with reference to FIGS. 1-3B) in a revolver, but otherwise are preferably used instead as following projectiles fully arranged within a case between the propellant and the first projectile of a cartridge used in a semi-automatic firearm. This prevents jamming of a firearm, as non-conical projectiles can increase the risk of jamming in semi-automatic firearms. Due to the cavities in each, the projectiles 400, 410 are optimized for inflicting a maximum degree of damage to a target. In conjunction with the use of multiple projectiles in a single cartridge, the shape of the projectiles 400, 410 thus aids a person firing cartridges according to embodiments of the present disclosure to hit and incapacitate a target. In some embodiments, the projectiles 400, 410 can include a gas check on a propellant end (e.g., the bottom end as illustrated in FIG. 4). Alternatively, or in addition, in some embodiments a gas check can be included at the leading end (e.g., the top end as illustrated in FIG. 4) of either projectile. For example, if the projectile 400, 410 is used behind a leading projectile, a gas check can be used between the projectile 400, 410 and the leading projectile in order to prevent the projectile 400, 410 from deforming as it is fired and before it impacts a target.

In some embodiments, the exterior cavities 402, 412 of the projectiles 400, 410 can be packed at least partially with non-compressible material. The non-compressible material can include, for example, polyethylene granules.

Figure 5:
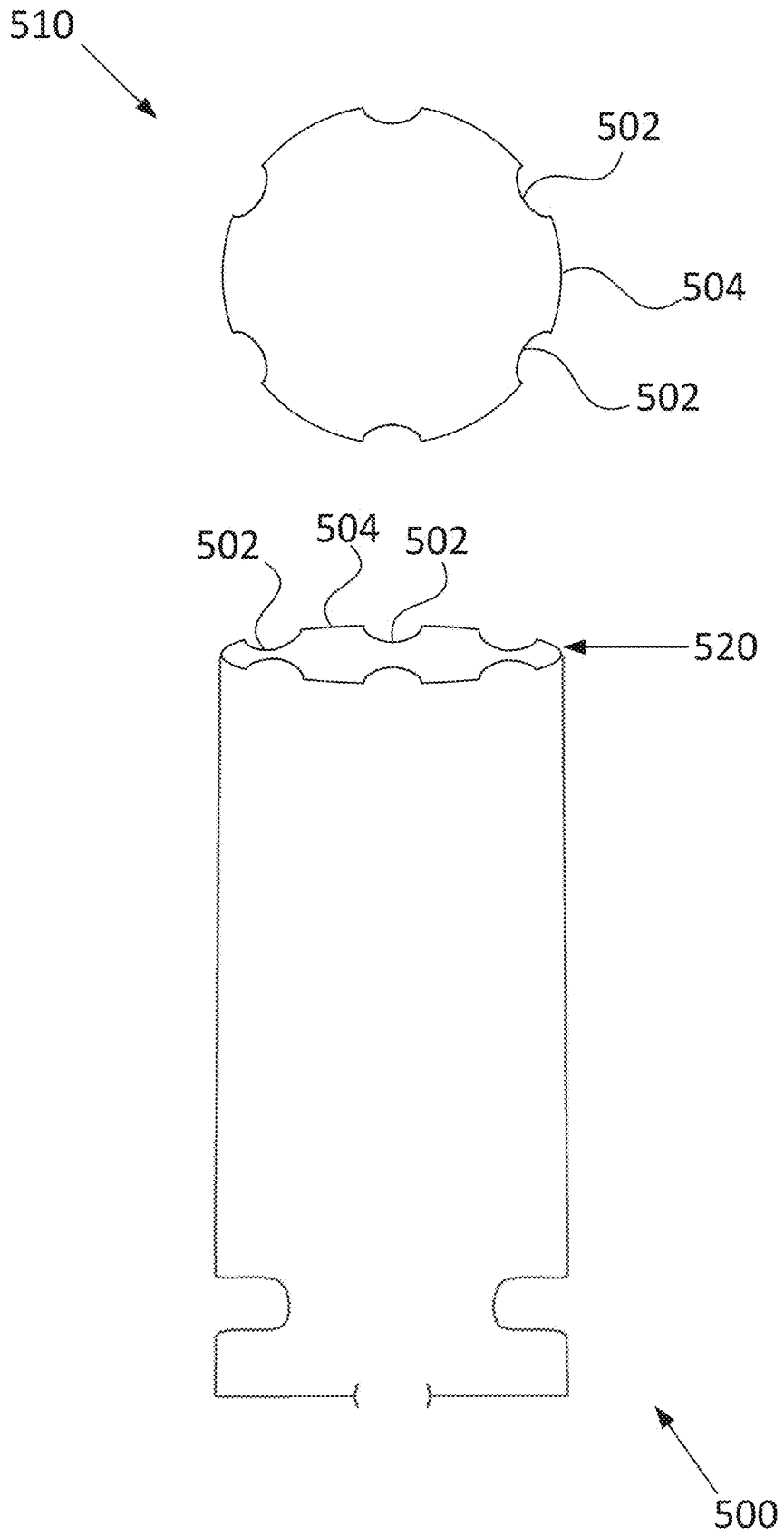
FIG. 5 illustrates a cartridge case with discrete roll crimps alternating with taper crimps.

FIG. 5 illustrates a cartridge case 500 with discrete roll crimps 502. In particular, the case 500 has an open end 520 configured to be crimped to a leading projectile (e.g., the first projectiles as illustrated and described with reference to FIGS. 1A-3B). Whereas conventional crimping includes a consistent form of crimping about an entire circumference of the open end of a case, the case 500 of FIG. 5 includes a plurality of discrete roll crimps 502 uniformly or evenly distributed about a circumference of the open end 520 separated by tapered crimps 504. In the illustrated embodiment, the open end 520 has six roll crimps 502. It will be readily appreciated that more or fewer roll crimps 502 can be included in a case 500 without departing from the spirit of the present disclosure. For example, in some embodiments, the open end of a case can include anywhere from three to twelve crimps and provide the advantages described hereafter with reference to the case 500 of FIG. 5.

The open end 520 also includes continuous regions in which a taper crimp 504 is provided between the roll crimps 502. The taper crimps 504 are also crimped to a projectile, but are crimped differently than the roll crimps 502. For example, the roll crimps 502 can comprise exaggerated crimps (e.g., greater in depth and/or degree of crimping) relative to the tapered crimps 504. The roll crimps 502 can even involve crimping of the case into a projectile (e.g., causing the case to penetrate, bite into, or dig into the projectile). The foregoing crimps ensure that projectiles are properly seated in a case, and prevents projectiles from being unseated by recoil experienced when firing other cartridges in a firearm. For example, if a cartridge is arranged at the topmost position of a magazine such that it is to be fired after a chambered round, the recoil experienced in the firearm as a result of the chambered round being fired may cause a projectile to be unseated without proper crimping. The crimping described above with reference to the present disclosure reduces the likelihood of such unseating. Moreover, because an increased quantity of propellant can be preferable in order to ensure that multiple projectiles are fired with sufficient velocity from a single cartridge, the crimping according to the present disclosure ensures that projectiles are seated properly to withstand greater firing pressures than standard or conventional rounds. In addition, the use of discrete tapered crimps 504 with roll crimps 502 therebetween instead of one continuous form of crimping about the entire circumference of the open end 520 helps keep a cartridge seated properly in a firearm by preventing it from slipping out of the firearm's chamber and into the barrel. Therefore, a cartridge according to the present disclosure configured for use in a semi-automatic firearm preferably includes roll crimps 502 alternating with light tapered crimps 504. The crimping described in the present disclosure is not limited only to multiple-projectile cartridges. For example, the foregoing combination of roll crimps and tapered crimps can also provide the above-described benefits when used with cartridges including only one projectile in a semi-automatic firearm.

The foregoing alternating roll crimps are also particularly advantageous for self-defense applications because a cartridge with roll crimps is less prone to allowing a projectile to become unseated after repeated loading and unloading of a cartridge in a firearm. In particular, self-defense weapons tend to be fired less frequently than weapons intended for other purposes, which can lead to cartridges being rotated in and out of the firearm's chamber and magazine(s) without being fired. When a cartridge is repeatedly loaded and unloaded into/out of a chamber, this can lead to gradual weakening of a casing's tapered crimps against a projectile. In just one illustrative example, this can happen when a firearm owner loads a cartridge into a chamber during some time of day, and then unloading the cartridge for safety reasons (e.g., when removing the firearm from their person) during other periods of the day. As a result, the same cartridge can be subject to jostling and forces associated with loading and unloading many more times than intended for a typical cartridge. When such forces are applied unequally to a cartridge (e.g., by being applied more strongly to a projectile than to a case by repeated and ordinary loading and unloading of a cartridge), an undesirable condition in which projectiles become unseated or loose can result. The roll crimps described herein reduce the likelihood of such unseating or loosening of projectiles by increasing the overall crimping strength and providing multiple roll crimps that can act redundant to one another. In a similar manner, the roll crimps reduce the likelihood of projectiles being unseated due to a hot load. A hot load cartridge is configured for higher internal pressures upon firing due to higher quantities of propellant being included in the cartridge, and can thereby cause more powerful recoil sufficient to unseat other cartridges stored in a firearm's magazine.

FIG. 5 also illustrates a top view 510 of the case 500 looking through the open end 520 to a closed end of the shell. Although projectiles that would be seated within the case 500 are not illustrated in FIG. 5, the top view 510 illustrates schematically how exaggerated tapers can be used as roll crimps 502 about the circumference of an open end 520 to ensure extra seating strength of projectiles in a case that are alternated with light tapered crimps that help keep the cartridge appropriately seated in a semi-automatic chamber.

It will be readily appreciated that embodiments of the present disclosure can also be configured with alternating crimps as shown in FIG. 5. For example, the embodiment illustrated in FIG. 5 with alternating crimps can be used in semi-automatic firearms, but a consistent roll crimp around the entire circumference of the open end of a case would be preferable for revolvers. For semi-automatic firearms, a cartridge with multiple projectiles can be crimped using only a tapered crimp around the entire circumference of the open end of the case.

Features and advantages described in the present disclosure are illustrated by the following examples, which demonstrate the ballistic performance of cartridges having multiple projectiles in varying configurations. The examples demonstrate that a smaller second projectile being arranged to follow a larger lead projectile of the appropriate caliber diameter results in increased projectile spread, resulting in a higher propensity to create separate wound channels in a target and thereby increasing stopping power of the cartridge for self-defense applications.

In the first and second examples, a cartridge with two projectiles was fired from a .357 Magnum with a three-inch barrel, made commercially available by Chiappa Firearms, headquartered in Brescia, Italy (with facilities in Dayton, Ohio) under the Rhino™ mark. The cartridges of each of the first example and second example were fired approximately 15 feet away from a paper target.

Figure 6:
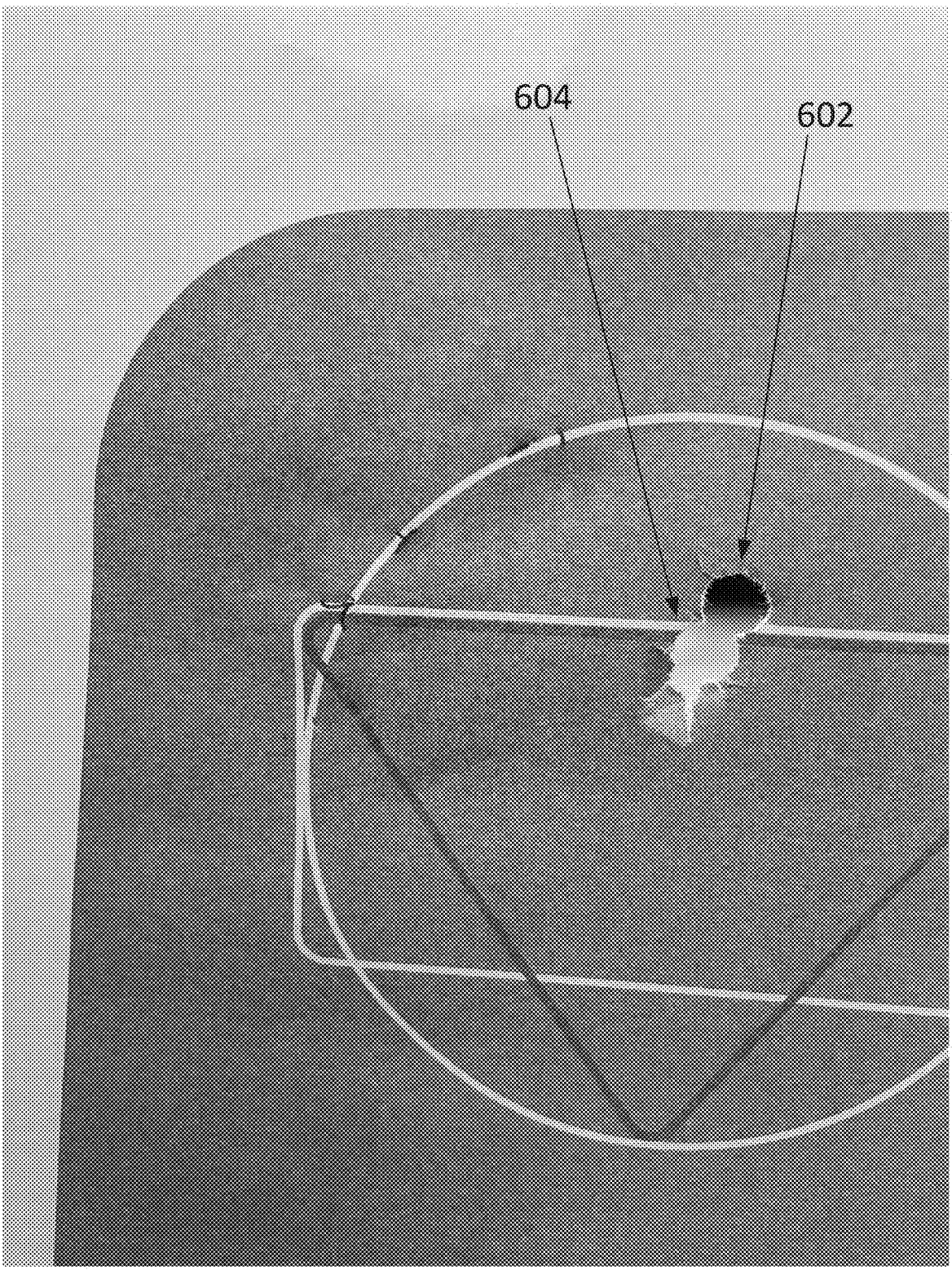
FIG. 6 is a photograph of a paper target struck by projectiles of a first cartridge according to the present disclosure.

FIG. 6 is a photograph of a paper target struck by projectiles of a cartridge according to a first example of the present disclosure during an experimental shoot conducted with a prototype cartridge. The first cartridge was configured as a .38 Special with two wadcutters each having a diameter of 0.357 inches and each having a mass of 61 grains. As shown in FIG. 6, it was found that the holes 602, 604 made by the wadcutters overlapped slightly, with the lead wadcutter producing a clean hole 602 and the second wadcutter forming a more ragged hole 604 with some tearing at its periphery.

Figure 7:
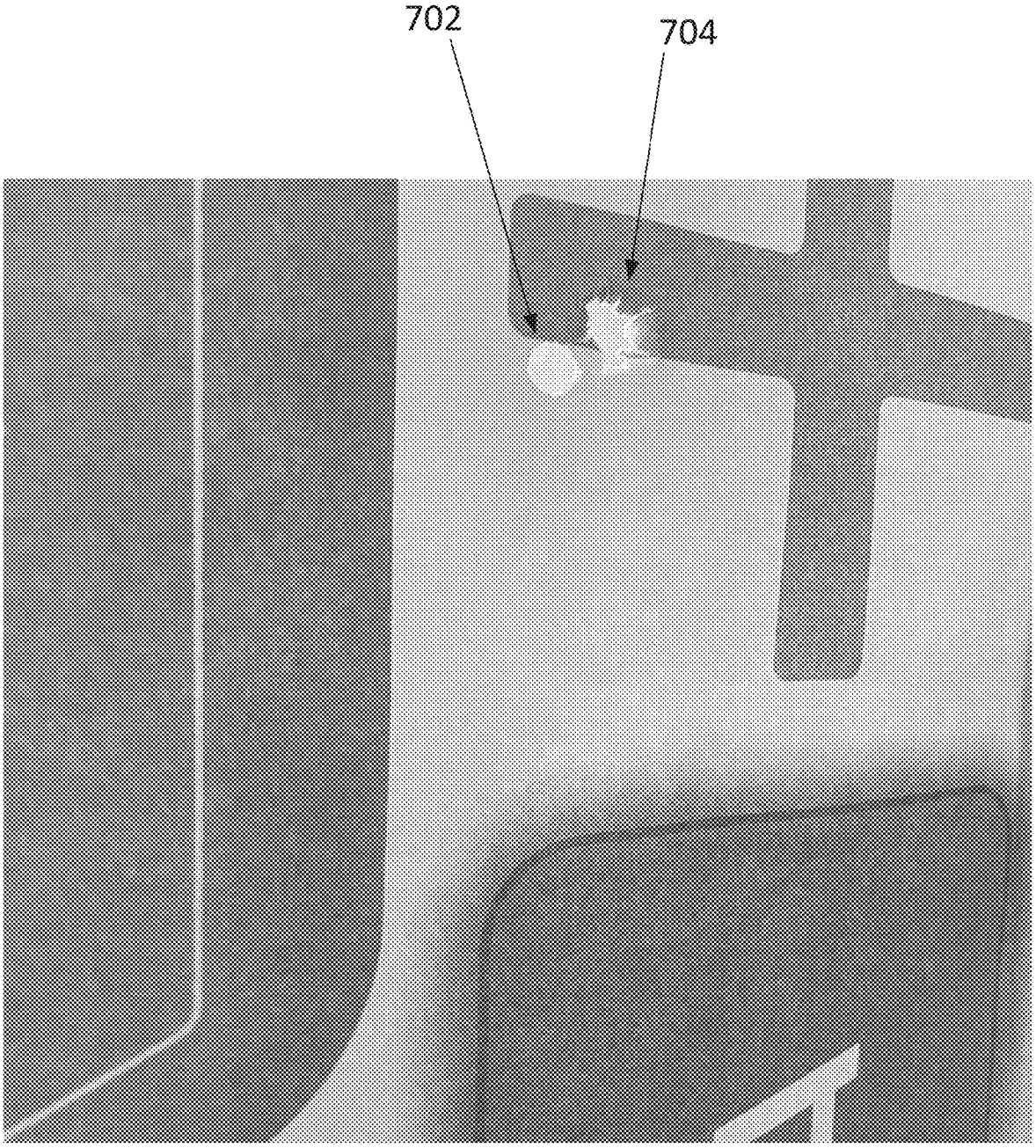
FIG. 7 is a photograph of a paper target struck by projectiles of a second cartridge according to the present disclosure.

FIG. 7 is a photograph of a paper target struck by projectiles of a cartridge according to a second example of the present disclosure during an experimental shoot conducted with a prototype cartridge. The second cartridge was configured identically to the first cartridge as a .38 Special with two wadcutters, except that the second projectile is slightly smaller than the first projectile. In particular, the lead wadcutter had a diameter of 0.357 inches and a mass of approximately 61 grains and the second wadcutter had a diameter of 0.355 inches with a mass of approximately 51 grains. As shown in FIG. 7, the holes 702, 704 formed by both wadcutters do not overlap and are more spread apart from one another in comparison to the holes formed by the projectiles of the first cartridge in FIG. 6. As such, experimental results confirm that a smaller second projectile can lead to an increased spread that is more desirable for self-defense applications, as the propensity to create separate wound channels in a target increases the stopping power of a cartridge. As also shown in FIG. 7, the lead wadcutter produced a clean hole 702 and the second wadcutter formed a more ragged hole 704 with some tearing at its periphery. It has been discovered that a ragged hole can be caused due to an angled impact of a projectile against a free hanging paper target, which can result from the first projectile striking the paper target and altering its angle. This is because when a wadcutter projectile impacts paper at an angle, the entire circumference of its cutting edge will not contact the paper target simultaneously, leading to uneven cutting and frictional forces against the target. It is understood that when a second projectile has a smaller diameter than a lead projectile, that the second projectile is prone to have a less accurate trajectory than the lead projectile, which is what causes the spreading effect described above and can lead to variations in impact angle of the second projectile. This is due at least in part to the fact that the second projectile will not fully engage with barrel rifling due to its reduced diameter.

Figure 8:
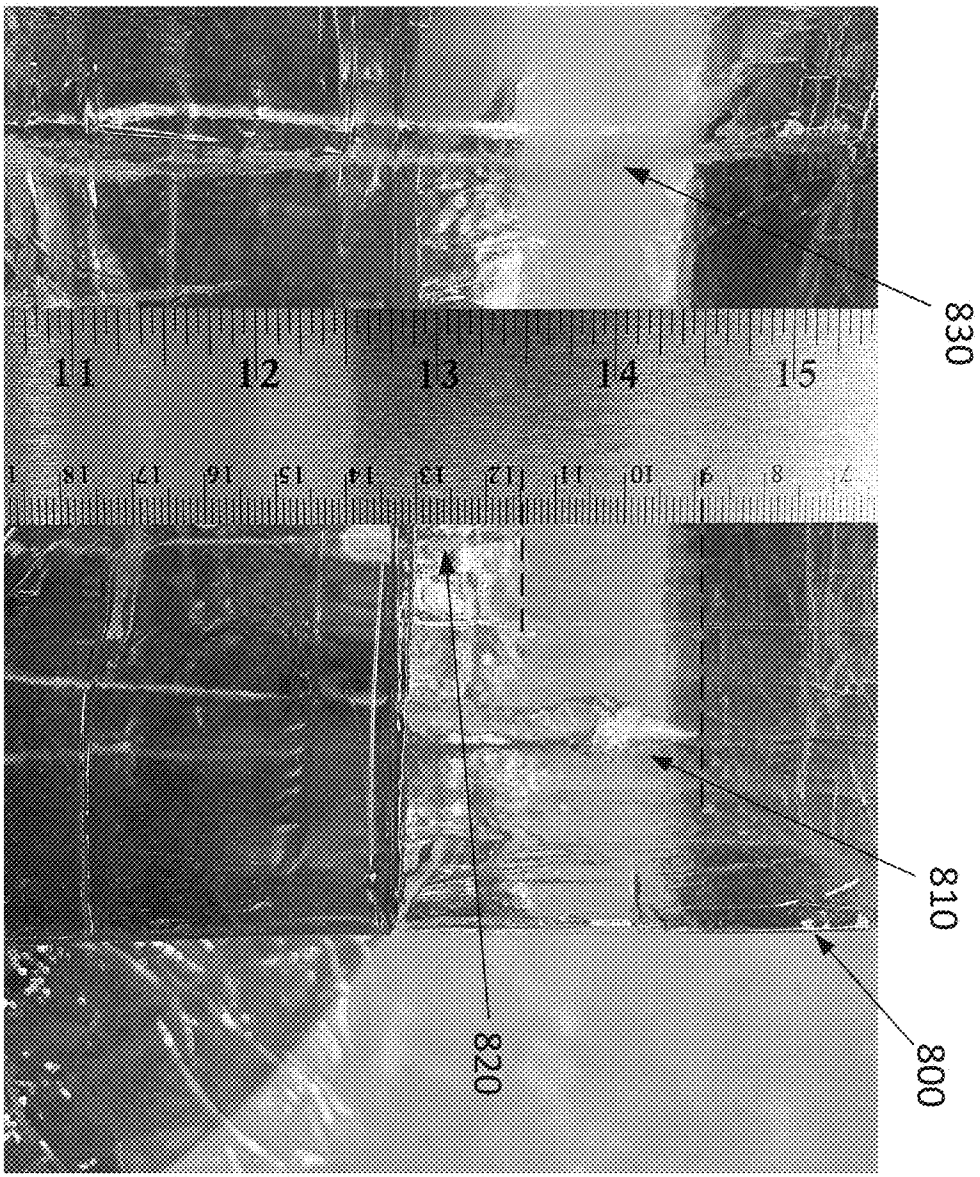
FIG. 8 is a photograph of ballistic gel struck by projectiles from a cartridge according to the present disclosure.

FIG. 8 is a photograph of a block of ballistic gel 800 struck by projectiles from a cartridge according to the present disclosure during an experimental shoot conducted with a prototype cartridge. The cartridge was identical to that of the first cartridge fired according to FIG. 6. Four layers of a denim garment were placed around the ballistic gel 800 such that projectiles would have to pass through the denim before penetrating the ballistic gel, thereby simulating the effects projectiles would have on a human body in a self-defense scenario. Two wound channels 810, 820 were formed by the two wadcutter projectiles of the cartridge. As shown in FIG. 8, the wound channels 810, 820 diverge from one another slightly. The projectiles penetrated to an approximate depth of 14.5 inches (for wound channel 810 on the right) and 13.5 inches (for wound channel 820 on the left), which demonstrates sufficiently deep penetration to stop or neutralize a struck target (whereas a penetration depth of less than 12 inches or greater than 18 inches would, for example, not meet penetration depth protocols established by the Federal Bureau of Investigation). The penetration depth of each projectile in the ballistic gel 800 also indicates that penetration is not so deep as to risk over-penetration, which could lead to projectiles dangerously passing through an intended target and causing collateral damage. Shotgun shells and some self-defense cartridges may provide limited or uncontrolled spread, but often do so at significantly increased risk of over-penetrating and causing collateral damage at close range (or under-penetration at long range). It is noted that the wound channels 810, 820 extend as illustrated to about 14.5 and 13.5 inches in depth and beyond a final resting place of the projectiles in the ballistic gel 800, as the projectiles rebound at the end of their trajectories to a shallower depth than the overall wound channel. Although the wound channels 810, 820 had a closer starting point upon striking the ballistic gel, a considerable separation between the wound channels 810, 820 is formed when the projectiles penetrated deeper into the ballistic gel.

FIG. 8 also illustrates control wound channel 830 formed from a conventional hollow point projectile and .38 Special pressure. The conventional hollow point projectile was clogged with the denim arranged against the ballistic gel 800 upon impacting it, which caused the hollow point projectile to penetrate entirely through the block of ballistic gel 800. This over-penetration is dangerous in self-defense applications, as the hollow point projectile can cause collateral damage to objects and/or persons behind an intended target.

Figure 9:
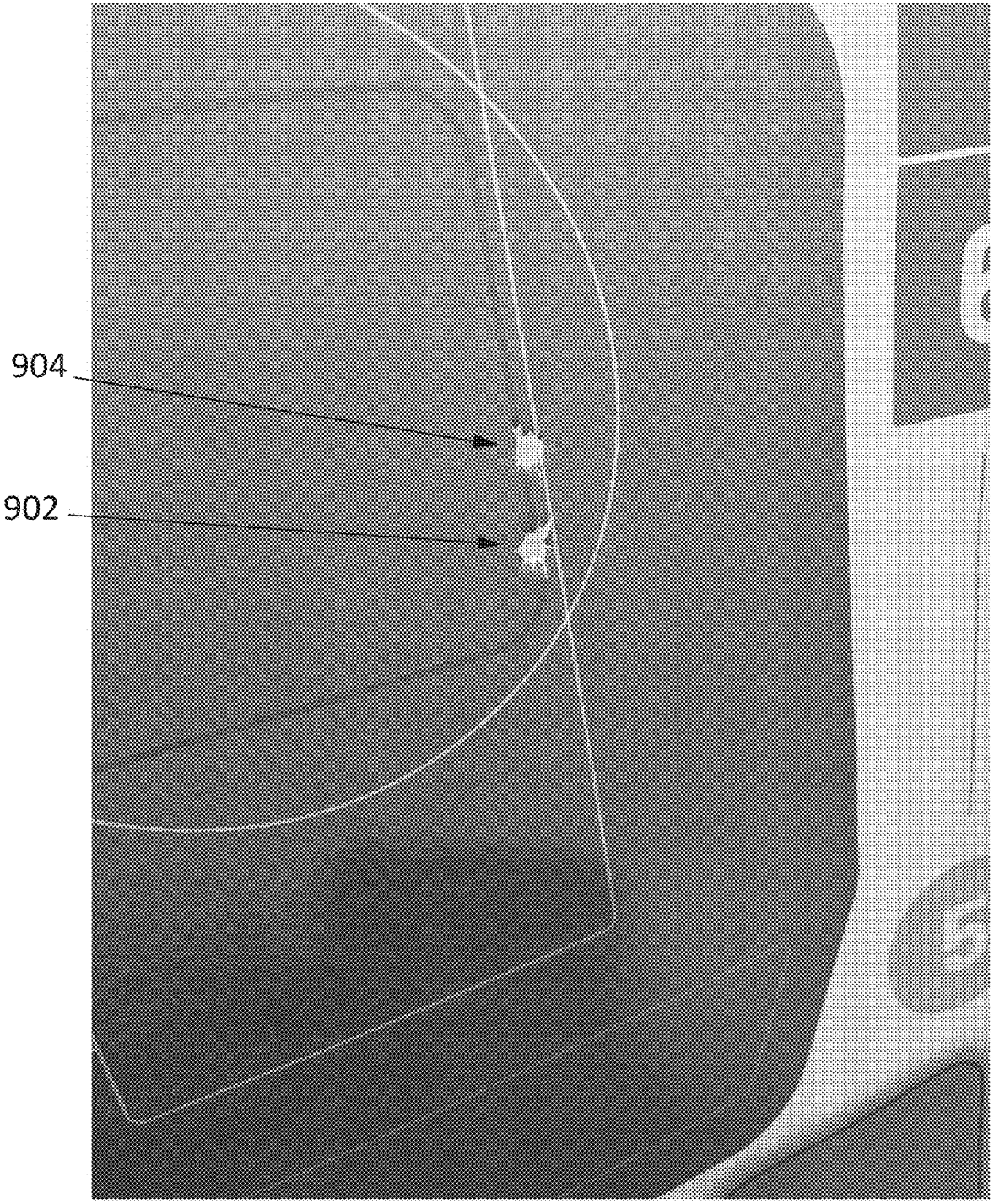
FIG. 9 is a photograph of a paper target struck by projectiles of a third cartridge according to the present disclosure.

FIG. 9 is a photograph of a paper target struck by projectiles of a cartridge according to a third example of the present disclosure during an experimental shoot conducted with a prototype cartridge. In the third example, the cartridge was configured similarly to the first and second cartridges described above with regard to FIGS. 6 and 7, except that the third example cartridge was configured as a 9 mm cartridge and the cartridge of the third example was fired approximately 20 feet away from a paper target. The first projectile was configured as a conical projectile and the second projectile arranged within the case and between the primer and first projectile was configured as a wadcutter. Approximately 6.6 grains of gunpowder was added to the cartridge for experimental purposes, although it will be readily understood that less powder can be used without significantly impacting the performance of the cartridge. The first and second projectiles were approximately 56 grains each. As shown in FIG. 9, the first and second projectiles impacted the target with sufficient spread to create separate wound channels, as shown by holes 902, 904, much like the cartridges according to FIGS. 6-8. Moreover, the third example cartridge was used in a semi-automatic firearm and resulted in full cycling of the firearm, thereby confirming fully functional efficacy of cartridges according to the present disclosure in semi-automatic firearms. The third example demonstrates that even at higher pressures, multiple projectile cartridges according to the present disclosure nevertheless achieve the intended spread when striking a target.

The foregoing examples demonstrate that cartridges with multiple projectiles according to the present disclosure provide separate wound channels in a target, thereby increasing cartridge stopping power in self-defense applications. Moreover, the foregoing examples demonstrate that reducing the size and/or weight of the second projectile (e.g., the projectile between the leading projectile and the primer of the cartridge) can lead to increased separation in the trajectories of the projectiles, thereby leading to further separation in wound channels of a struck target. This increases the likelihood of one of the projectiles striking a vital part of a target. The foregoing examples also demonstrate that cartridges according to the present disclosure have strong penetrative performance while avoiding over-penetration, which is ideal for self-defense applications.

The present disclosure also relates to methods for assembling each of the cartridges disclosed herein. An exemplary method for assembling a cartridge can include priming a new brass cartridge by inserting or seating a primer into the base of the cartridge case. The open end of the case can then be expanded slightly. A charge of smokeless powder is then placed inside the cartridge case. Then, a gas check can optionally be inserted into the case. Two or more projectiles are then inserted into the case and can be seated without needing to shave the sides of the projectiles due to the expansion of the open end.

If one of the fully enclosed projectiles is hollowed, polyethylene or polypropylene dust, powder, and/or microspheres are inserted to fill the hollow cavity of the projectiles so as to prevent deformation of the projectile in the firearm's barrel during firing and thereby prevent catastrophic pressure build up. If the cartridge is configured for firing in a revolver, a roll crimp is applied to case about the leading projectile. If the cartridge is configured for firing in a semi-automatic firearm, a tapered crimp can be applied to the open end of the case, or distinct spot roll crimps can be applied evenly spaced about the circumference of the open end with tapered crimps applied between the roll crimps.

The disclosure is further illustrated by the following exemplary aspects. However, the disclosure is not limited by the following aspects.

(1) A cartridge for a firearm, comprising a first projectile, a second projectile, a gas check arranged against the second projectile, a case, a propellant, and a primer configured to ignite the propellant. The second projectile is arranged between the first projectile and the gas check. The propellant is arranged between the gas check and an end surface of the case in which the primer is arranged. The case is crimped against the first projectile.

(2) The cartridge according to aspect 1, wherein the first projectile and the second projectile are each configured as a wadcutter.

(3) The cartridge according to aspect 1, wherein the first projectile is configured as a semi-wadcutter and the second projectile is configured as a wadcutter.

(4) The cartridge according to aspect 1, wherein the first projectile has a conical end and a non-conical end, wherein the second projectile is configured as a wadcutter, and wherein the non-conical end of the first projectile abuts the second projectile.

(5) The cartridge according to any of the preceding aspects, wherein the second projectile is configured as a hollow point and wherein a gas check is arranged between the first and second projectiles.

(6) The cartridge according to any of the preceding aspects, wherein the first and second projectiles each have a weight of 50 to 112 grains.

(7) The cartridge according to any of the preceding aspects, wherein the first projectile has a greater weight than the second projectile.

(8) The cartridge according to any of the preceding aspects, wherein the second projectile has a diameter that is 0.002 inches less than a diameter of the first projectile.

(9) The cartridge according to any of the preceding aspects, wherein the first and second projectiles do not comprise lead.

(10) The cartridge according to any of the preceding aspects, wherein the second projectile is configured as a hollow point having an annular cavity arranged around a central post.

(11) The cartridge according to any of the preceding aspects, wherein the case includes an open end with discrete roll crimps arranged evenly distributed relative to one another along a circumference of the open end.

(12) The cartridge according to aspect 11, wherein the case further includes tapered crimps between the roll crimps along the circumference of the open end.

(13) The cartridge according to aspect 12, wherein the open end alternates between tapered and roll crimps along the entire circumference of the open end.

(14) The cartridge according to aspects 12 or 13, wherein the roll crimps are crimped further toward the first projectile than the tapered crimps between the roll crimps.

(15) The cartridge according to any of aspects 11-14, wherein the roll crimps bite into the first projectile.

(16) The cartridge according to any of the preceding aspects, wherein the first projectile and the second projectile are configured to remain intact upon impact with a target.

(17) The cartridge according to any of the preceding aspects, wherein no additional fittings or material are arranged in the case between the first projectile and the second projectile.

(18) The cartridge according to any of the preceding aspects, wherein the first projectile is configured to create a first wound channel in a target and wherein the second projectile is configured to create a second wound channel in the target, the first and second wound channels being distinct from one another.

(19) The cartridge according to any of the preceding aspects, wherein the first and second projectiles each have a weight of 50-100 grains.

(20) The cartridge according to any of the preceding aspects, wherein the case has a length of 1.155 inches.

(21) The cartridge according to any of the preceding aspects, wherein the case has an open-end diameter of 0.379 inches.

(22) The cartridge according to any of the preceding aspects, wherein the first and second projectiles each have a diameter of 0.357 inches or wherein the first projectile has a diameter of 0.357 inches and the second projectile has a diameter of 0.355 inches.

(23) The cartridge according to any of aspects 1-18, wherein the cartridge is configured as a .44 S&W Special cartridge such that the case has a length of 1.160 inches.

(24) The cartridge according to any of aspects 1-18 and 23, wherein the case has an open-end diameter of 0.456 inches.

(25) The cartridge according to any of aspects 1-18 and 23-24, wherein the first projectile has a diameter of 0.430 inches and second projectile has a diameter of from 0.427 to 0.430 inches.

(26) The cartridge according to any of aspects 1-19, wherein the case has a length of 0.754 inches.

(27) The cartridge according to any of aspects 1-19 and 26, wherein the case has an open-end diameter of 0.380 inches.

(28) The cartridge according to any of aspects 1-19 and 26-27, wherein the first and second projectiles each have a diameter of 0.355 inches, or wherein the first projectile has a diameter of 0.355 inches and the second projectile has a diameter of 0.353 inches.

(29) The cartridge according to any of aspects 1-18, wherein the cartridge is a 10 mm caliber cartridge and the case has a length of 0.992 inches.

(30) The cartridge according to any of aspects 1-18 and 29, wherein the case has a diameter of 0.423 inches.

(31) The cartridge according to any of aspects 1-18 and 29-30, wherein the first and second projectiles each have a diameter of 0.400 inches, or wherein the first projectile has a diameter of 0.400 inches and the second projectile has a diameter of 0.398 inches.

(32) The cartridge according to any of aspects 1-18, wherein the cartridge is a .40 S&W cartridge and the case has a length of 0.850 inches.

(33) The cartridge according to any of aspects 1-18 and 32, wherein the case has an open-end diameter of 0.423 inches.

(34) The cartridge according to any of aspects 1-18, wherein the case has a length of 0.898 inches.

(35) The cartridge according to any of aspects 1-18 and 34, wherein the cartridge is configured as a .45 ACP cartridge and the case has an open-end diameter of 0.473 inches.

(36) The cartridge according to any of aspects 1-18 and 34-35, wherein the first and second projectiles each have a diameter of 0.451 inches, or wherein the first projectile has a diameter of 0.451 inches and the second projectile has a diameter of 0.449 inches.

(37) The cartridge according to any of aspects 1-18, wherein the cartridge is configured as a .45 Colt cartridge and the case has a length of 1.285 inches.

(38) The cartridge according to any of aspects 1-18 and 37, wherein the case has an open-end diameter of 0.480 inches.

(39) The cartridge according to any of aspects 1-18 and 37-38, wherein the first and second projectiles each have a diameter of 0.452 inches or wherein the first projectile has a diameter of 0.452 inches and the second projectile has a diameter of 0.450 inches.

(40) The cartridge according to any of the preceding aspects, wherein the first and/or the second projectile comprise an alloy containing 87.25% by weight bismuth, 12% by weight tin, and 0.75% by weight antimony, or wherein the first and/or the second projectile comprise an alloy containing 87.37% by weight bismuth, 11.89% by weight tin, and 0.74% by weight antimony.

(41) The cartridge according to any of aspects 1-18 and 37-40, further comprising a third projectile arranged between the first projectile and the second projectile.

(42) The cartridge according to aspect 41, wherein the third projectile is configured as a wadcutter.

(43) The cartridge according to any of aspects 41-42, wherein the first, second, and third projectiles each have a weight of up to 112 grains.

(44) The cartridge according to any of aspects 1-18 and 40-43, wherein the case has a length of 1.285 inches.

(45) The cartridge according to any of aspects 1-18 and 40-44, wherein the case has a diameter of 0.480 inches.

(46) The cartridge according to any of aspects 1-18 and 40-45, wherein the first, second, and third projectiles each have a diameter of 0.452 inches.

(47) The cartridge according to any of aspects 1-18 and 40-46, wherein the first projectile has a diameter of 0.452 inches and the second and third projectiles each have a diameter of 0.450 inches.

(48) The cartridge according to any of aspects 1-18 and 40, wherein the cartridge is configured as a 9 mm, .357 Magnum, .38 Special, 10 mm, .40 S&W, .44 S&W Special, .44 Magnum, .45 Long Colt, or .45 ACP cartridge.

(49) The cartridge according to any of aspects 41 and 42, wherein the cartridge is configured as a .357 Magnum, .44 Magnum, or .45 Long Colt cartridge.

(50) A method for assembling a cartridge for a firearm, the method comprising providing a cylindrical case with an open end, arranging a propellant in the case, arranging a gas check, a first projectile, and a second projectile in the case, such that the second projectile is arranged between the first projectile and the gas check and such that the first projectile protrudes at least partially from the case, and crimping the open end of the case against the first projectile along an entire circumference of the open end.

(51) The method according to aspect 50, wherein the crimping comprises roll crimps.

(52) The method according to any of aspects 50-51, wherein the crimping comprises tapered crimps.

(53) The method according to any of aspects 50-52, comprising further crimping the crimped open end at a plurality of discrete positions arranged evenly distributed about the circumference of the open end, and wherein the further crimps comprise roll crimps.

(54) The method according to aspect 53, wherein the further crimping comprises crimping the case into the first projectile such that the case at least partially penetrates into the first projectile.

(55) The method according to any of aspects 50-54, comprising arranging a third projectile in the case such that the third projectile is positioned entirely within the case and such that the third projectile is arranged between the first projectile and the second projectile.

(56) A method for striking a target, the method comprising arranging a cartridge within a chamber of a firearm, aiming the firearm at a target, and causing a firing pin of the firearm to strike a primer arranged within the cartridge such that the primer ignites a propellant within the cartridge, and such that at least two projectiles arranged within the cartridge are thereby expelled from the firearm to create at least two separate wound channels in the target.

It shall be noted that the preceding aspects are illustrative and not limiting. Other exemplary combinations are apparent from the entirety of the description herein. It will also be understood by one of ordinary skill in the art that various embodiments may be used in various combinations with the other embodiments provided herein.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the present disclosure (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the present disclosure and does not pose a limitation on the scope of the present disclosure unless otherwise claimed. No language in the specification should be construed as indicating any non-claimed element as essential to the practice of the present disclosure.

Preferred embodiments of this disclosure are described herein, including the best mode known to the inventors for carrying out the present disclosure. Variations of those preferred embodiments may become apparent to those of ordinary skill in the art upon reading the foregoing description. The inventors expect skilled artisans to employ such variations as appropriate, and the inventors intend for the present disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

The invention claimed is:

1. A cartridge for a firearm, comprising:
a projectile;
a gas check;
a case;
a propellant; and
a primer configured to ignite the propellant,
wherein the propellant is arranged between the gas check and an end surface of the case in which the primer is arranged,
wherein the case is crimped against the projectile,
wherein the case includes an open end with discrete roll crimps distributed along a circumference of the open end,
wherein the case further includes tapered crimps between the roll crimps along the circumference of the open end, and wherein the open end alternates between tapered and roll crimps along the entire circumference of the open end, and
wherein each of the roll crimps and tapered crimps are crimped to the projectile.

2. The cartridge according to claim 1, wherein the cartridge further comprises a second projectile arranged between the projectile and the gas check.

3. The cartridge according to claim 2, wherein the projectile has a conical end and a non-conical end, wherein the second projectile is configured as a wadcutter, and wherein the non-conical end of the projectile abuts the second projectile.

4. The cartridge according to claim 2, wherein the second projectile is configured as a hollow point and wherein a second gas check is arranged between the projectile and second projectile.

5. The cartridge according to claim 2, wherein the projectile and the second projectile each have a weight of 50 to 112 grains.

6. The cartridge according to claim 2, wherein the projectile has a greater weight than the second projectile.

7. The cartridge according to claim 2, wherein the second projectile has a diameter that is 0.002 inches less than the diameter of the projectile.

8. The cartridge according to claim 2, wherein the projectile and/or the second projectile comprise an alloy containing 87.25% by weight bismuth, 12% by weight tin, and 0.75% by weight antimony, or wherein the projectile and/or the second projectile comprise an alloy containing 87.37% by weight bismuth, 11.89% by weight tin, and 0.74% by weight antimony.

9. The cartridge according to claim 2, wherein the projectile and the second projectile do not comprise lead.

10. The cartridge according to claim 2, wherein the second projectile is configured as a hollow point having an annular cavity arranged around a central post.

11. The cartridge according to claim 1, wherein the roll crimps are crimped further toward the projectile than the tapered crimps between the roll crimps.

12. The cartridge according to claim 1, wherein the roll crimps bite into the projectile.

13. The cartridge according to claim 2, further comprising a third projectile arranged between the projectile and the second projectile.

14. The cartridge according to claim 13, wherein the third projectile has a weight of between 50 to 112 grains.

15. A method for assembling a cartridge for a firearm, the method comprising:
providing a cylindrical case with an open end;
arranging a propellant in the case;
arranging a gas check and a projectile and
crimping the open end of the case against the projectile such that the open end of the case has discrete roll crimps distributed along a circumference of the open end and tapered crimps between the roll crimps, wherein the open end alternates between tapered and roll crimps along the entire circumference of the open end, and
wherein each of the roll crimps and tapered crimps are crimped to the projectile.

16. The method according to claim 15, further comprising arranging a second projectile between the projectile and the gas check.

17. The method according to claim 16, comprising arranging a third projectile in the case such that the third projectile is positioned entirely within the case and such that the third projectile is arranged between the projectile and the second projectile.

* * * * *